US008287178B2

(12) United States Patent
Lamon

(10) Patent No.: US 8,287,178 B2
(45) Date of Patent: Oct. 16, 2012

(54) METHOD AND APPARATUS FOR RESERVOIR MIXING

(75) Inventor: Douglas Lamon, Burlington (CA)

(73) Assignee: Landmark Structures I, L.P., Fort Worth, TX (US)

( * ) Notice: Subject to any disclaimer, the term of this patent is extended or adjusted under 35 U.S.C. 154(b) by 856 days.

(21) Appl. No.: 11/954,692

(22) Filed: Dec. 12, 2007

(65) Prior Publication Data

US 2008/0151684 A1 Jun. 26, 2008

Related U.S. Application Data

(63) Continuation-in-part of application No. 11/382,110, filed on May 8, 2006.

(51) Int. Cl.
*B01F 5/02* (2006.01)

(52) U.S. Cl. ..... 366/173.2; 366/167.1; 366/182.4

(58) Field of Classification Search ..... 137/846; 239/127, 435, 592; 366/167.1, 173.2, 182.4
See application file for complete search history.

(56) References Cited

U.S. PATENT DOCUMENTS

| | | | | |
|---|---|---|---|---|
| 531,304 | A | | 12/1894 | Dousman |
| 926,144 | A | | 6/1909 | Sherow |
| 981,098 | A | | 1/1911 | McCaskell |
| 1,468,226 | A | * | 9/1923 | Colburn et al. ..... 366/164.6 |
| 1,468,887 | A | * | 9/1923 | Sterrick ..... 141/301 |
| 1,580,476 | A | * | 4/1926 | Fassio ..... 68/184 |
| 1,849,437 | A | | 3/1932 | Rucker |
| 1,878,825 | A | | 9/1932 | Caise |
| 1,961,548 | A | | 6/1934 | Caise |
| 1,992,261 | A | | 2/1935 | Traudt |
| 2,013,370 | A | * | 9/1935 | Tygart ..... 222/621 |
| 2,045,164 | A | * | 6/1936 | Richards ..... 239/127 |
| RE20,488 | E | * | 8/1937 | Zinkil ..... 239/403 |
| 2,192,806 | A | | 3/1940 | Smith |
| 2,592,904 | A | | 4/1952 | Jackson |
| 2,603,460 | A | | 7/1952 | Kalinske |
| 3,202,281 | A | | 8/1965 | Weston |
| 3,292,861 | A | * | 12/1966 | Koreichi Kawamura et al. ..... 239/17 |
| 3,375,942 | A | | 4/1968 | Boram |
| 3,386,182 | A | | 6/1968 | Lippert |
| 3,586,294 | A | * | 6/1971 | Strong ..... 366/163.2 |
| 3,647,188 | A | | 3/1972 | Solt |
| 3,648,985 | A | | 3/1972 | Matweecha |
| 3,692,283 | A | | 9/1972 | Sauer et al. |
| 3,718,319 | A | | 2/1973 | Weisman |
| 3,762,170 | A | * | 10/1973 | Fitzhugh ..... 405/38 |
| 3,762,689 | A | | 10/1973 | Hege |
| 3,810,604 | A | | 5/1974 | Reiter |
| 3,846,079 | A | * | 11/1974 | Alagy et al. ..... 422/234 |

(Continued)

*Primary Examiner* — David Sorkin
(74) *Attorney, Agent, or Firm* — Hodgson Russ LLP

(57) ABSTRACT

The invention provides a system and method for filling a reservoir through one or a plurality of inlet nozzles to encourage mixing. The inlet nozzles include a specifically designed size reduction between the main line or branch to which the inlet nozzle is attached and the nozzle pipe itself; a specifically designed nozzle pipe length which, combined with the pressure increase provided by the size reduction, will produce the most appropriate jet flow; and a specifically designed location and orientation of the inlet nozzle within the reservoir. These parameters produce a developed turbulent jet flow which, when the inlet nozzle is positioned at the appropriate elevation and oriented in the appropriate direction(s), will direct the developed turbulent jet flow with the appropriate momentum to reach the surface of the water with initial major mixing taking place in this area. A corresponding draining system and method is also disclosed.

11 Claims, 20 Drawing Sheets

U.S. PATENT DOCUMENTS 3,847,375 A 11/1974 Kuerten et al.
4,164,541 A * 8/1979 Platz et al. ..... 422/198
4,187,029 A 2/1980 Canale et al.
4,312,167 A 1/1982 Cazaly et al.
4,327,531 A 5/1982 Cazaly et al.
4,332,484 A 6/1982 Peters
4,465,020 A 8/1984 Schafer
4,491,414 A 1/1985 Hayatdavoudi et al.
4,578,921 A 4/1986 Cazaly et al.
4,586,825 A 5/1986 Hayatdavoudi
4,660,336 A 4/1987 Cazaly et al.
4,716,917 A 1/1988 Schmidt
4,886,446 A * 12/1989 Courrege ..... 431/329
4,945,933 A * 8/1990 Krajicek et al. ..... 134/167 R
5,048,598 A 9/1991 Takemae et al.
5,283,990 A * 2/1994 Shank, Jr. ..... 451/90
5,332,312 A 7/1994 Evanson
5,456,533 A 10/1995 Streiff et al.
5,606,995 A * 3/1997 Raftis ..... 137/846
6,016,839 A 1/2000 Raftis et al.
6,109,778 A 8/2000 Wilmer
6,217,207 B1 * 4/2001 Streich et al. ..... 366/137
6,237,629 B1 5/2001 Zelch
6,464,210 B1 10/2002 Teran et al.
6,488,402 B1 12/2002 King et al.
6,818,124 B1 11/2004 Simmons
6,821,011 B1 11/2004 Crump
7,025,492 B2 4/2006 Dorsch et al.
7,252,429 B2 8/2007 Yungblut
7,309,155 B2 12/2007 Sarrouh et al.
7,517,460 B2 4/2009 Tormaschy et al.
7,748,650 B1 * 7/2010 Sloan ..... 239/593
2002/0105855 A1 8/2002 Behnke et al.
2003/0205277 A1 11/2003 Raftis et al.
2003/0210606 A1 11/2003 Chase et al.
2005/0111297 A1 5/2005 Sarrouh et al.
2005/0162972 A1 7/2005 Dorsch et al.
2006/0245295 A1 11/2006 Dorsch et al.
2006/0291326 A1 12/2006 Crump
2008/0130404 A1 6/2008 Sarrouh et al.
2008/0151684 A1 6/2008 Lamon

* cited by examiner

METHOD AND APPARATUS FOR RESERVOIR MIXING

CROSS REFERENCE TO RELATED APPLICATIONS

This application claims benefit as a continuation-in-part of U.S. patent application Ser. No. 11/382,110 filed May 8, 2006, which application is incorporated by reference herein.

FIELD OF THE INVENTION

The present invention relates to fluid storage tanks either in ground, above ground or elevated hereinafter generically referred to as "reservoirs" and more particularly relates to systems and methods for the mixing of fluids in reservoirs and thereby preventing "stagnation" (as hereinafter defined) of fluids in reservoirs, excessive "aging" (as hereinafter defined) of fluids in reservoirs and the formation of an "ice cap" (as hereinafter defined). The present specification refers to potable water as an example of a stored fluid, however, the invention is equally applicable to other types of fluids where mixing is either required or desirable.

BACKGROUND OF THE INVENTION

Potable water reservoirs such as standpipes (normally tanks with height greater than diameter), ground storage tanks (normally tanks with height less than diameter) or elevated storage tanks are connected to water distribution systems and are used, among other things, to supply water to the systems and/or maintain the pressure in the systems during periods when water consumption from the system is higher than the supply mechanism (pumps or pumping stations) to the system can provide. The reservoirs are therefore usually filling during periods when the system has supply capacity that exceeds the current consumption demand on the system or discharging into the system when the system has supply capacity that is less than the current consumption demand on the system. Potable water reservoirs typically contain water which has been treated through the addition of a disinfectant to prevent microbial growth in the water. Disinfectant concentrations in stored water decrease over time at a rate dependant upon a number of factors such as temperature, cleanliness of the system etc. This can result in unacceptable water quality if the period of retention of the water, or any part thereof in a reservoir, becomes too long or if the incoming fresh, treated water is not properly mixed with the existing stored water in a reservoir. Therefore, the age or retention period of water within potable water reservoirs and the mixing of incoming fresh water with the existing water are of concern to ensure that the quality of the water will meet the regulatory requirements for disinfectant concentrations. In addition, during periods of below freezing weather, the top surface of the water will cool and may freeze (this is referred to as an ice cap) unless it is exchanged for or mixed with the warmer water entering the reservoir. An ice cap may adhere to the reservoir walls and become thick enough to span the entire surface even when the water is drained from below. If sufficient water is drained from below a fully spanning ice cap, a vacuum is created, collapsing the ice cap which in turn can create, during the collapse, a second vacuum which can be much larger than the reservoir venting capacity and can result in an implosion of the roof and possibly the upper walls of the reservoir.

Water reservoirs are often filled and drained from a single pipe or a plurality of pipes located at or near the bottom of the reservoir. Under these conditions, when fresh water is added to the reservoir, it enters the lower part of the reservoir and when there is demand for water in the system, it is removed from the lower part of the reservoir resulting in a tendency for the last water added to be the first to be removed. This can be referred to as short circuiting. Temperature differences between stored water and new water may cause stratification which can in turn exacerbate short circuiting and water aging problems. Filling and draining from a single or a plurality of pipes located at or near the bottom creates little turbulence particularly in areas within the reservoir remote from these inlet and outlet pipes. As a result, the age or residency time of some waters within parts of the reservoir can be very long, resulting in loss of disinfectant residual, increase in disinfection by-products, biological growth, nitrification and other water quality and/or regulatory issues. This is referred to herein as "stagnation" or "stagnant water". A perfect system would provide a first in, last out scenario ("cycling"), however, perfect cycling is either not possible or is cost prohibitive. A preferred system provides a tendency toward cycling combined with a first mixing of the new water with existing tank contents that are most remote from the point of withdrawal. A preferred system would efficiently mix new water entering the tank with the existing tank contents thereby preventing stagnation. A preferred system would provide total mixing of the new water with the existing tank contents in the shortest period of time. A preferred system would reduce the water age or residency time and related problems. A preferred system would eliminate the potential for ice cap formation. A preferred system would use the energy of the water entering and exiting the reservoir to perform all of the mixing functions. A preferred system would be adaptable to both of the two common types of reservoirs: i) reservoirs having separate inlet and outlet pipes which fill the reservoir through one pipe or a plurality of ports on one pipe (inlet) and drain the reservoir through a separate pipe or a plurality of ports on a separate pipe (outlet), said inlet and outlet pipes being remotely valved and remotely connected or remaining separate; and ii) reservoirs having a common inlet/outlet pipe which fills the reservoir and drains the reservoir through a common or singular pipe, manifold or header.

Prior art exists which attempts to promote mixing in reservoirs through a variety of systems and methods, all of which to varying degrees are inefficient or ineffective. These proposed systems and methods, and their deficiencies, include the following:

a) The introduction of water into a reservoir through plain end inlet pipe(s) which are remotely spaced either horizontally or vertically from the outlet pipe(s) and the reliance on the physical separation only of the inlet and outlet pipes to accomplish mixing. Due to the fact that the preponderance of reservoirs fill at a very low rate of flow, this method introduces the water gently into the reservoir, does not encourage mixing throughout the reservoir, allows short circuiting of the water between the inlet and outlet locations and results in zones of stagnant water (dead zones).

b) The introduction of water into a reservoir 1) through holes in inlet pipes or manifolds, 2) through tees in inlet pipes or manifolds, and 3) through either of the preceding equipped with reducers, duckbill check valves or a combination of the two to increase the velocity of the incoming water. All of these methods create a hydraulically chaotic introduction of the fresh water resulting in an almost immediate mixing with the existing water in close proximity only and creating little effect on areas remote from the points of introduction.

c) The introduction of water into a reservoir via a singular or a plurality of inlet and outlet pipes or ports, remote from each other oriented roughly in the same plane or elevation, often at or near the bottom of the reservoir, using the inlet ports similar to or as outlined in (b) above. These piping arrangements are typically ineffective or inefficient in that the water is not introduced properly as noted in (b) and tends to short circuit or flow directly from the inlet to the outlet, thus being unable to eliminate dead zones that occur in the reservoir.

d) The introduction of water into a reservoir via a singular inlet riser preceded by a reducer. This piping arrangement, due to the length of the inlet pipe following the reducer, fails to develop the characteristics of a jet flow and results in the mixing or lack of mixing as defined in (a) above.

e) The introduction of water into a reservoir via a singular or a plurality of inlet and outlet pipes or ports, remote from each other oriented roughly in perpendicular parallel planes or planes at 90 degrees to each other using the inlet ports similar to or as outlined in (b). These piping arrangements also are typically ineffective or inefficient in that the water is not introduced properly as noted in (b) and tends to short circuit vertically or flow directly from the inlet to the outlet thus being unable to eliminate dead zones that occur in the reservoir.

A deficiency of prior art systems and methods in general is the failure of the prior art to address the necessity of positioning and configuring the outlet pipes so as to discourage any tendency toward short circuiting and encourage a broad and general withdrawal of fluid across the full horizontal area of the reservoir or, when applicable, a vertical area.

It is desirable to provide an inexpensive and easily maintained mixing system for use in reservoirs in order to reduce the potential for dead zones, stagnation and excessive aging of the contained water and further to reduce the potential for the formation of dangerous ice caps.

SUMMARY OF THE INVENTION

The present invention provides a system and method for filling a reservoir through one or a plurality of inlet nozzles, which inlet nozzles include or are characterized by 1) a specifically designed size reduction between the main line or branch to which the inlet nozzle is attached and the nozzle pipe itself, 2) a specifically designed nozzle pipe length which, combined with the pressure increase provided by the size reduction, will produce the most appropriate jet flow, and 3) a specifically designed location and orientation of the inlet nozzle within the reservoir. The combination of the preceding parameters will produce a developed turbulent jet flow which, when the inlet nozzle is positioned at the appropriate elevation and oriented in the appropriate direction(s), will direct said developed turbulent jet flow with the appropriate momentum to reach the surface of the water with initial major mixing taking place in this area. The design of the inlet nozzle(s) based on the present invention should ideally be optimized with CFD (computational fluid dynamics) analysis or any other recognized fluid mechanics analysis using tank geometry and inlet rates for the specific project. The optimization would result in selecting a combination of the best mixing time and most cost effective system as well as operating directions for the user.

The present invention also provides a system and method for draining a reservoir from, normally, the bottom of the reservoir utilizing a horizontally oriented outlet header and a plurality of outlet pipes terminating in low loss contraction cones designed to induce drainage across the entire lower area of the reservoir. The design and dimensioning of the drain header, outlet pipes and low loss contraction cones should ideally be optimized with CFD analysis or any other recognized fluid mechanics analysis using tank geometry and withdrawal rates for the specific project.

BRIEF DESCRIPTION OF THE DRAWINGS

The present invention will be described by way of example only with reference to the following drawings:

FIG. 17 is also an elevation view of a standpipe reservoir or ground storage tank reservoir incorporating a mixing system formed in accordance with the present invention, wherein the mixing system includes a plurality of inlet nozzles and outlet cones mounted in series on parallel vertical headers located remote from each other;

FIG. 17 depicts the rectangular reservoir;

FIG. 17 depicts the standpipe or ground storage tank reservoir;

FIG. 19 is also an elevation view of a standpipe reservoir or ground storage tank reservoir incorporating a mixing system formed in accordance with the present invention, wherein the mixing system includes a plurality of inlet nozzles and outlet cones mounted in series on parallel vertical headers located remote from each other and having a common inlet/outlet header;

FIG. 19 depicts the rectangular reservoir; FIG. 19 depicts the standpipe or ground storage tank reservoir.

DETAILED DESCRIPTION OF THE INVENTION

Figure 1A:
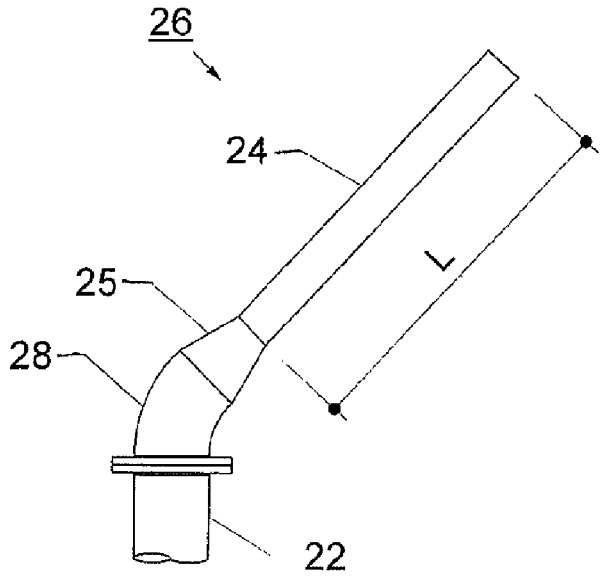
FIG. 1A is an elevational view of an inlet nozzle having a single nozzle pipe in accordance with an embodiment of the present invention.
Figure 1B:
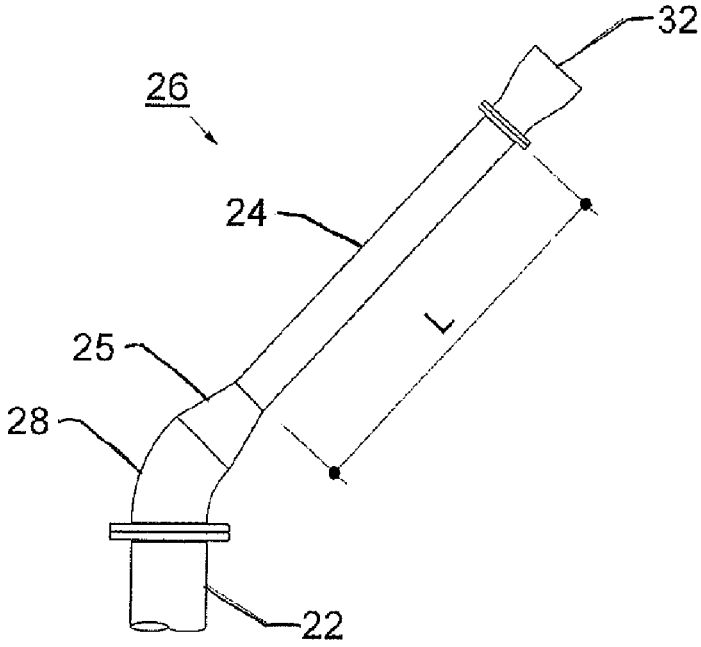
FIG. 1B is an elevational view of an inlet nozzle having a single nozzle pipe and a check valve positioned at an exit end of the nozzle pipe in accordance with an embodiment of the present invention.

FIGS. 1A through 5B show various inlet nozzles 26 which may be used in practicing the present invention. Inlet nozzle 26 in FIG. 1A includes a directional fitting 28, shown by way of example as a 45 degree elbow attached to inlet pipe 22, a reducer 25 extending from directional fitting 28 and designed to provide maximum velocity increase while avoiding problematic head loss due to excessive restriction, and a nozzle pipe 24 of length L extending from reducer 25 and designed to provide developed turbulent jet flow to the incoming water. While other nozzle configurations described below include a check valve for preventing backflow from the reservoir via the inlet nozzle, nozzle 26 does not require a check valve when the nozzle is used in a reservoir having separate inlet and outlet pipes because a check valve or directional valve is usually supplied remote from the actual water storage section of the reservoir. However, nozzle 26 does require a check valve when used in a reservoir having a common inlet/outlet pipe. In this regard, FIG. 1B shows an inlet nozzle 26 that is similar to that of FIG. 1A, except that it also includes a check valve 32 positioned at an exit end of nozzle pipe 24 for preventing backflow. In FIG. 1B, check valve 32 may be an elastomeric check valve when the incoming flow is relatively consistent and the elastomeric check valve is designed so that it opens fully under incoming consistent flow, provides minimal restriction or alteration to the characteristics of the flow at the end of nozzle pipe 24, and functions as a backflow preventor only. Other types of check valves may also be used, keeping in mind that the check valve is intended to function as a backflow preventor only, and should not substantially change flow characteristics of the inlet stream. FIG. 2A shows a nozzle 26 similar to that of FIG. 1A, except a double door check valve 32 is located between directional fitting 28 and reducer 25. The configuration of FIG. 2A may be used when the incoming flow is moderately variable and reducer 25 and length L of nozzle pipe 24 have been designed to accommodate the approximate average flow. The nozzle 26 shown in FIG. 2B includes an in-line elastomeric check valve 32 located between directional fitting 28 and reducer 25, and may be used when the incoming flow is highly variable and the purpose of in-line elastomeric check valve 32 is to provide some acceleration or momentum to even the very low water flow occasionally entering nozzle 26 by providing variable restriction.

Figure 3A:
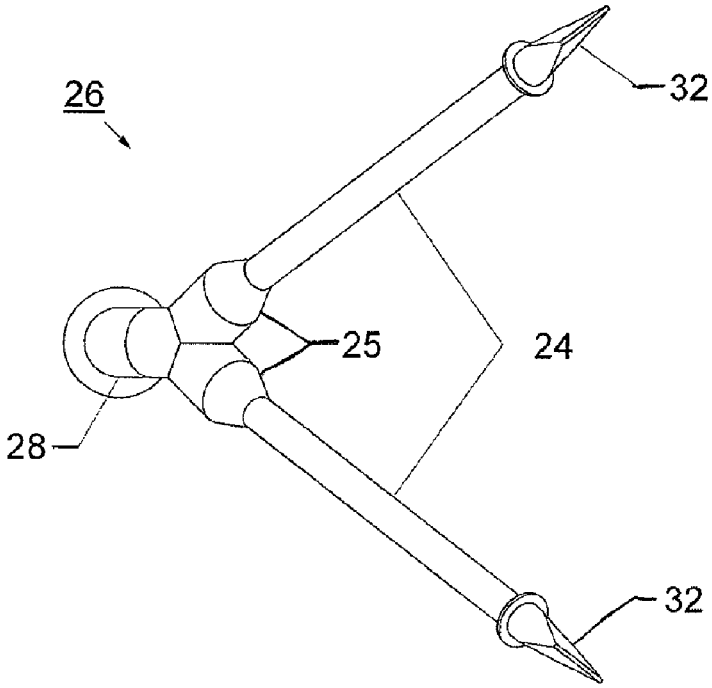
FIG. 3A is a plan view of a first alternate inlet nozzle having a pair of nozzle pipes.
Figure 3B:
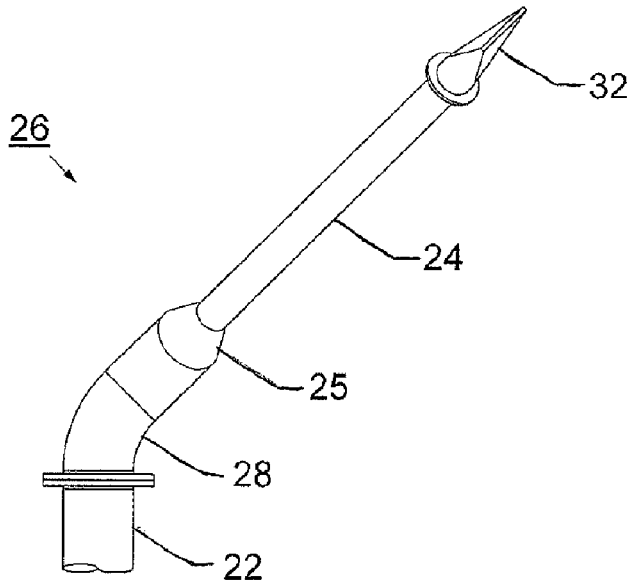
FIG. 3B is an elevational view of the alternate inlet nozzle shown in FIG. 3A.
Figure 4A:
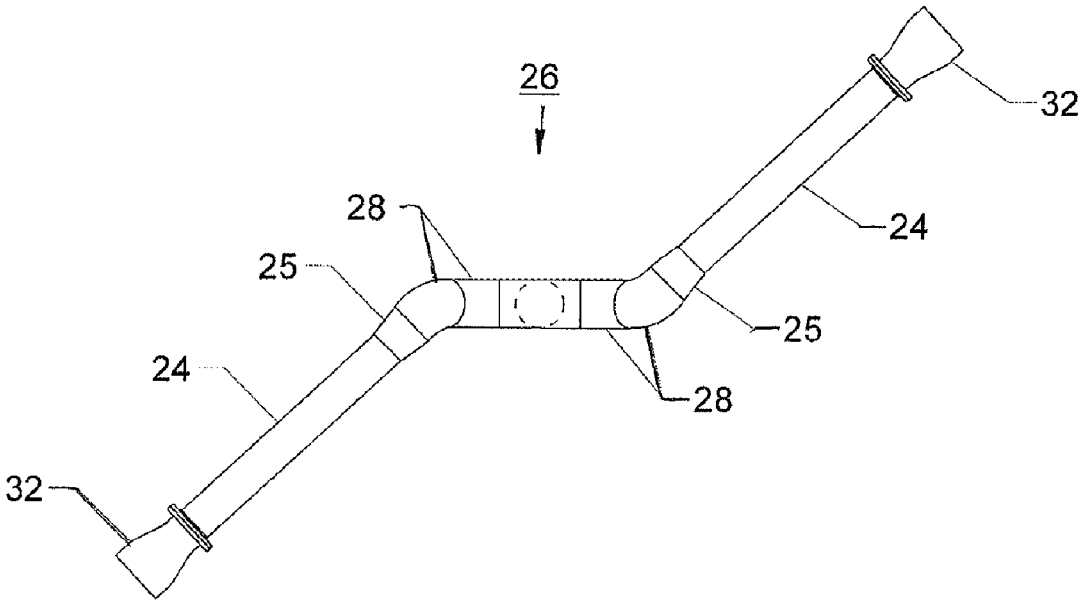
FIG. 4A is a plan view of a second alternate inlet nozzle having a pair of nozzle pipes.
Figure 4B:
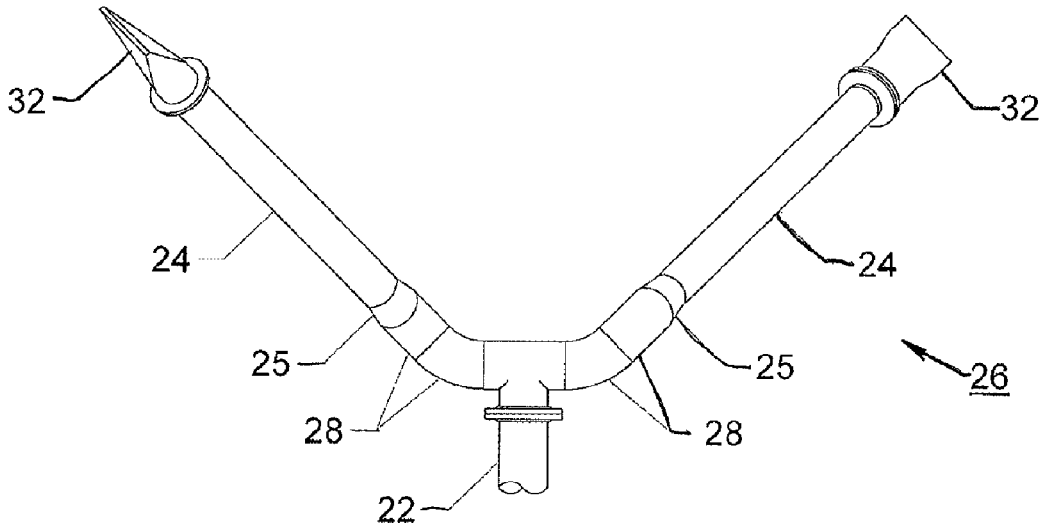
FIG. 4B is an elevational view of the alternate inlet nozzle shown in FIG. 4A.
Figure 5A:
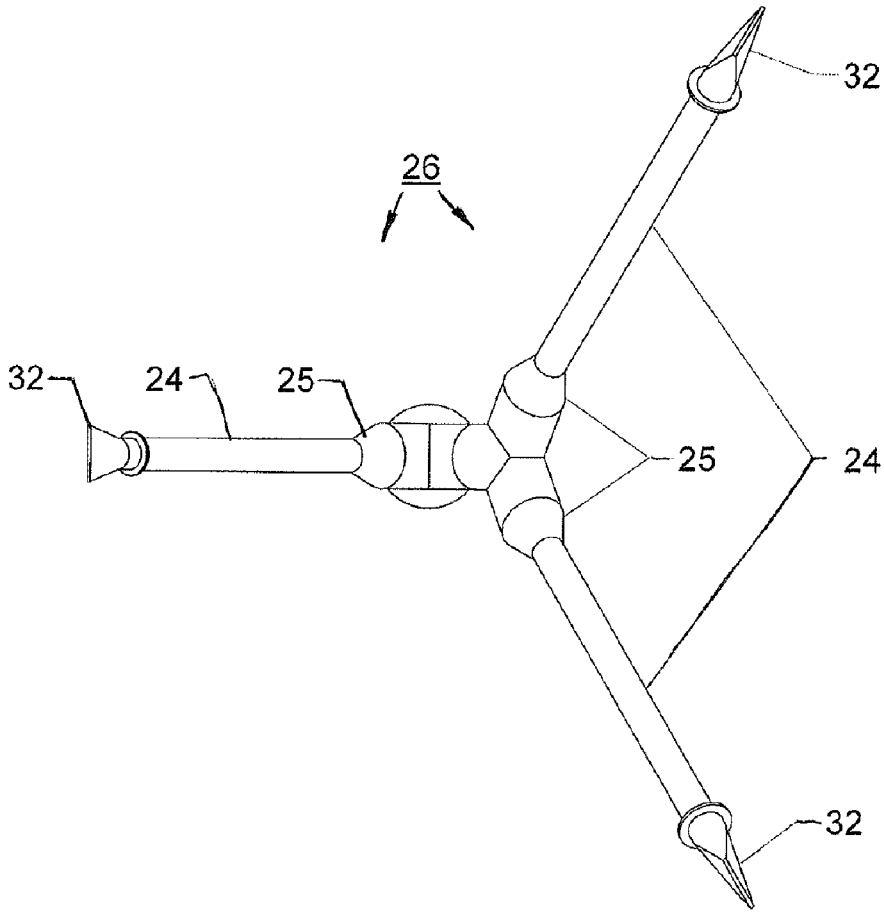
FIG. 5A is a plan view of a third alternate inlet nozzle having three nozzle pipes.
Figure 5B:
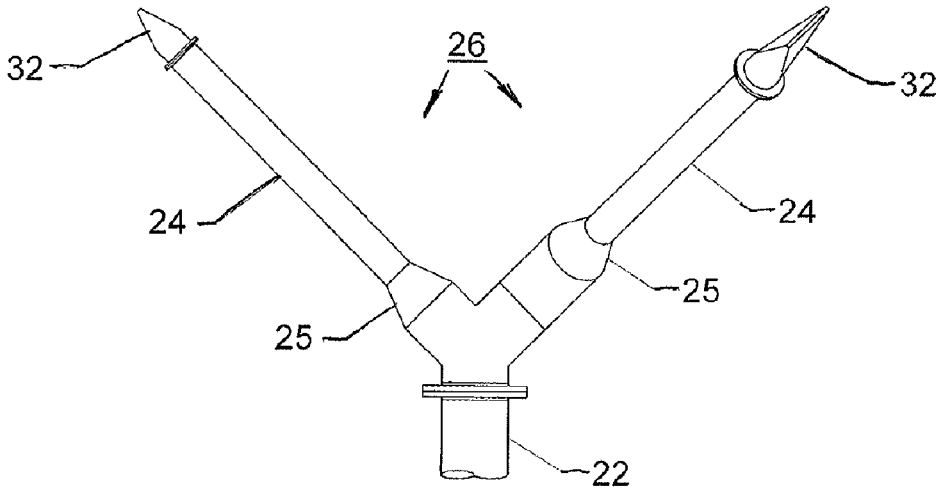
FIG. 5B is an elevational view of the alternate inlet nozzle shown in FIG. 5A.

FIGS. 3A, 3B, 4A, 4B, 5A, and 5B illustrate examples of alternative inlet nozzle configurations having a plurality of nozzle pipes. In FIGS. 3A and 3B, nozzle 26 includes a directional fitting 28 coupled to inlet pipe 22, a Y-fitting 21 coupled to directional fitting 28, a pair of reducers 25 respectively associated with the exit ends of Y-fitting 21, a pair of nozzle pipes 24 extending from the reducers 25, and a pair of check valves 32 positioned at the respective exit ends of nozzle pipes 24. FIGS. 4A and 4B show a nozzle 26 including a T-fitting 23 coupled to inlet pipe 22, directional fittings 28 extending from each exit end of T-fitting 23, a pair of reducers 25 arranged after directional fittings 28 in each flow stream, a pair of nozzle pipes 24 extending from the reducers 25, and a pair of check valves 32 positioned at the respective exit ends of nozzle pipes 24. FIGS. 5A and 5B show a three-way nozzle 26 formed using a pair of Y-fittings 21, wherein each branch of the nozzle includes a respective reducer 25, nozzle pipe 24, and check valve 32. The illustrated nozzle configurations are examples of the many possible alternative nozzle configurations which may be utilized without departure from the spirit of the present invention.

Figure 6:
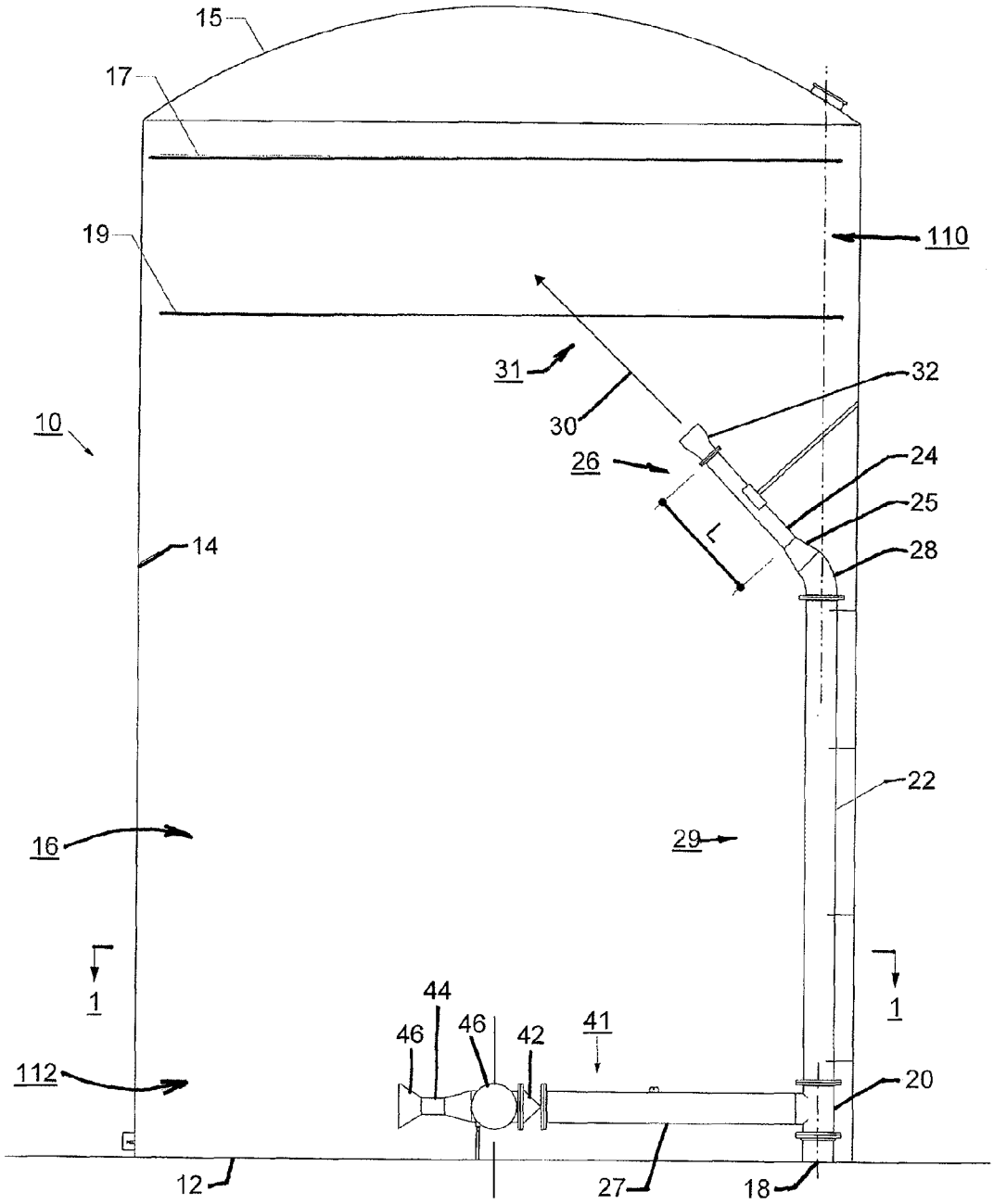
FIG. 6 is an elevation view of a standpipe reservoir or ground storage tank reservoir incorporating a mixing system formed in accordance with the present invention, wherein the mixing system is connected to a single inlet/outlet pipe communicating with the reservoir.
Figure 7:
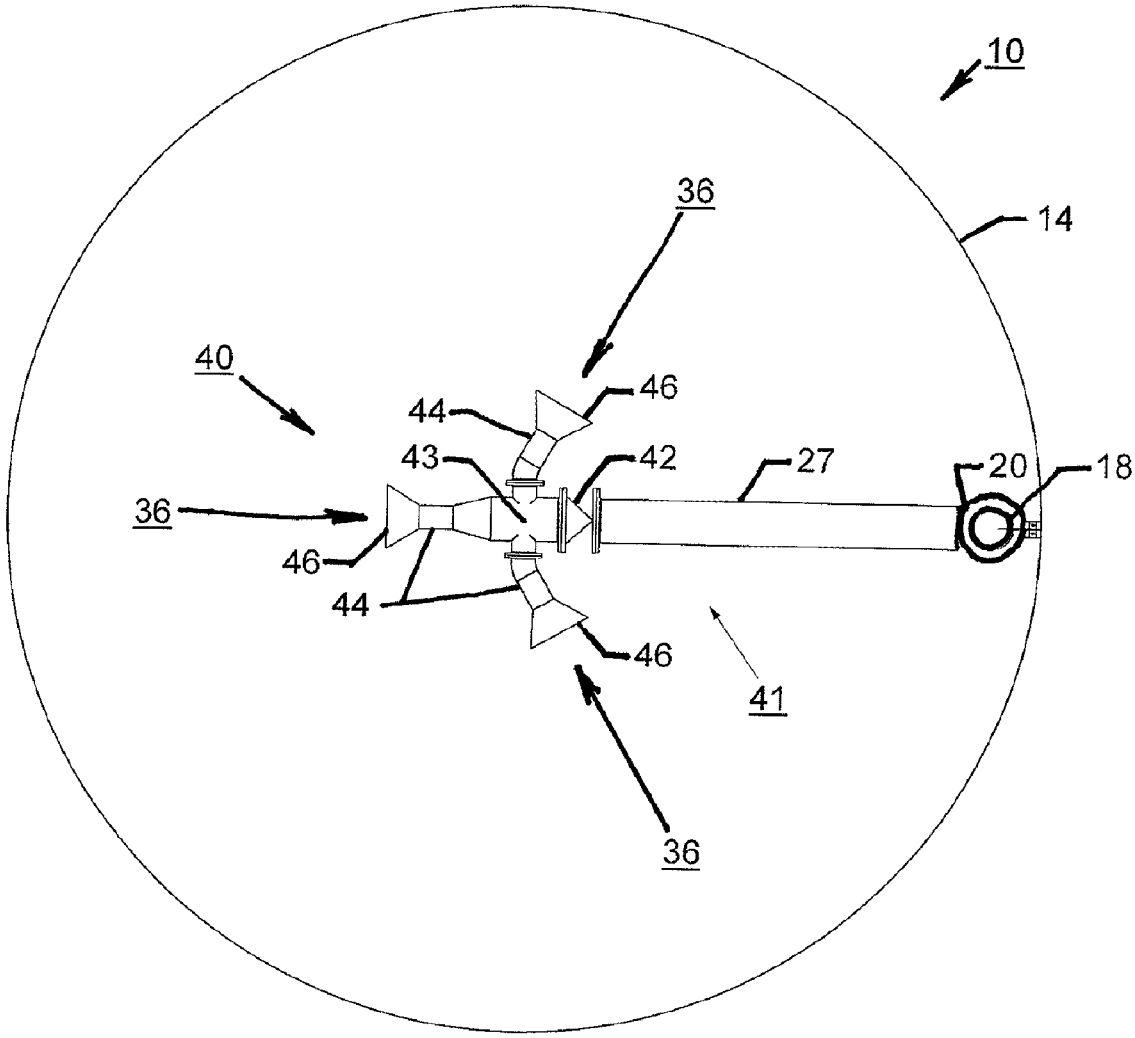
FIG. 7 is a plan view of the lower part of the reservoir shown in FIG. 6, taken along the line 1-1 in FIG. 6.

FIGS. 6 and 7 show an example of a standpipe reservoir or ground storage tank reservoir, generally designated as 10, storing water contents 16 and incorporating a mixing system in accordance with an embodiment of the present invention, wherein the mixing system is connected to a single inlet/outlet pipe 18 communicating with the reservoir. Reservoir 10 includes a bottom 12, a roof 15, and sidewall 14 connecting bottom 12 and roof 15. The water content in reservoir 10 includes an upper portion 110 which is the volume between the operating high water level 17 and the operating low water level 19 (generally referred to as the "operating range") and a lower portion 112. Reservoirs usually adopt the depicted cylindrical geometry, however, the invention is equally applicable to any tank or other type of water containing structure or vessel, of any cross section, in or above ground or elevated, with or without a roof or with a floating roof.

The purpose of the present invention is to promote complete mixing of reservoir contents 16, and therefore eliminate stagnation and ice cap formation, by introducing water to reservoir 10 in a way which creates an incoming developed turbulent jet flow in a location and direction which causes movement of all of the fluid within the reservoir and distribution and mixing of the incoming water throughout the reservoir, accompanied by withdrawal of water at an outlet location or locations remote from the inlet by a method which encourages withdrawal from a generalized area and discourages short circuiting. In this way, stagnant water or dead zones in tank 10 are prevented without using auxiliary mechanical devices.

An example mixing system of the present invention, as embodied in FIGS. 6 and 7, includes two separate sections designated generally as an inlet section 29 and an outlet section 41. Common to both inlet section 29 and outlet section 41 is inlet/outlet pipe 18 which is used to both feed and draw water into and out of reservoir 10. Inlet/outlet pipe 18 is shown entering reservoir 10 as a vertical pipe located adjacent to wall 14, but may enter the reservoir in a horizontal or inclined position at any location. Inlet section 29 is connected to outlet section 41 at a tee connection 20 as shown in FIG. 6.

Figure 2A:
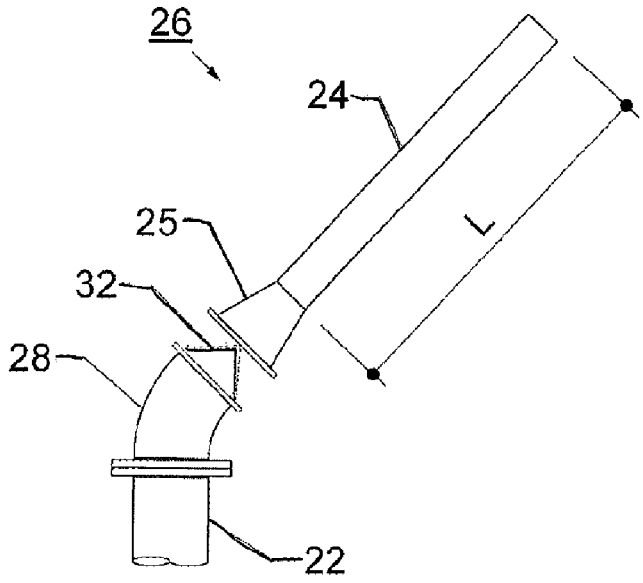
FIG. 2A is an elevational view of an inlet nozzle having a single nozzle pipe and a check valve positioned after a directional fitting of the nozzle and extending into a reducer of the nozzle in accordance with an embodiment of the present invention.
Figure 2B:
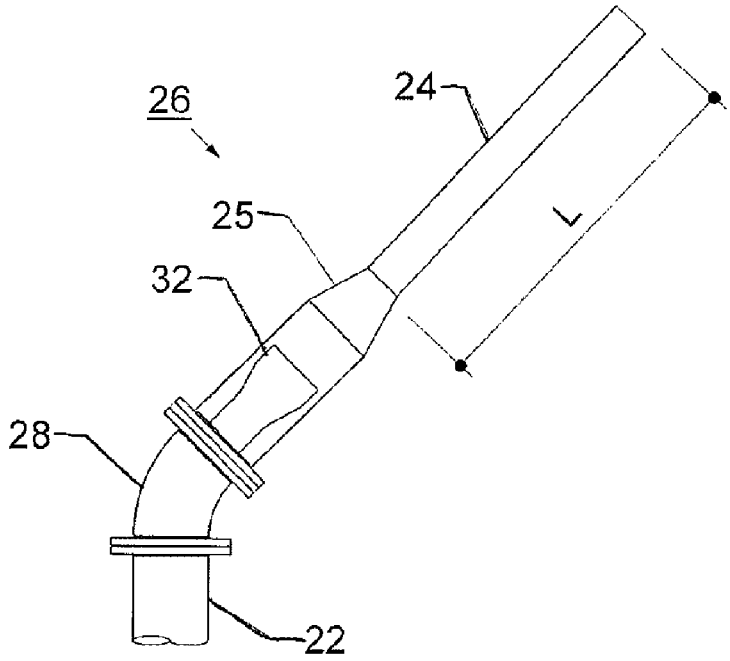
FIG. 2B is an elevational view of an inlet nozzle having a single nozzle pipe and a check valve positioned between a directional fitting and a reducer of the nozzle in accordance with an embodiment of the present invention.

Inlet section 29 includes inlet pipe 22 connected to inlet nozzle 26. Inlet nozzle 26 includes directional elbow 28, reducer 25, nozzle pipe 24 and check valve 32. Inlet nozzle 26 discharges incoming fresh water 31 in the form of a developed turbulent jet flow having a direction 30 relative to storage reservoir 10. Check valve 32 in FIG. 6 is shown as an elastomeric check valve but can be any type of check valve mounted at the end of nozzle pipe 24, which does not restrict the flow in inlet nozzle 26, or inline preceding nozzle pipe 24 as depicted in FIGS. 2A and 2B. Nozzle pipe 24 of length L, the amount of reduction in reducer 25 and the check valve positioning are designed, using the anticipated flow rate and water pressure entering feed pipe 22 when the reservoir is filling, to provide an inlet nozzle 26 which discharges a developed turbulent jet flow along jet direction 30 as depicted in FIG. 6. The jet flow has the appropriate velocity to reach the surface of the liquid in varying buoyancy conditions.

Fresh water entering reservoir 10 via inlet pipe 22 is directed to inlet nozzle 26. Water under pressure being injected through designed inlet nozzle 26 develops flow characteristics which direct the incoming fresh water 31 as a developed turbulent jet flow along jet direction 30 to the water surface which is typically, under operating conditions, between high water level 17 and low water level 19.

Inlet nozzle 26 is connected to inlet pipe 22 at a height above reservoir bottom 12 which ensures that the discharge end of inlet nozzle 26 is normally below low water level 19 of reservoir 10, but sufficiently high that the developed turbulent jet flow along jet direction 30 created by incoming fresh water 31 issuing from inlet nozzle 26 is capable of reaching the water surface at water level 17. Therefore, as the water level varies between low water level 19 and high water level 17, the jet created by incoming fresh water 31 will reach the surface of the water.

Inlet nozzle 26 is oriented by directional fitting 28 which is shown for purposes of illustration as a 45 degree elbow so that the developed turbulent jet flow along jet direction 30 created by incoming fresh water 31 issuing from inlet nozzle 26 reaches the water surface at water level 17 at approximately the center of the water surface, from which point said turbulent jet flow initiates a flow in upper portion 110 first to an area of wall 14 most remote from inlet nozzle 26 and subsequently deflected by wall 14 in a vertical and horizontal rotating direction to further enhance total mixing with reservoir contents 16.

Outlet section 41 in the example embodiment of FIGS. 6 and 7 will now be described. Outlet section 41 includes an outlet pipe 27 connected by a tee connection 20 to inlet/outlet pipe 18. Outlet section 41 further includes an outlet manifold shown generally as 40 which includes the following major components namely, a plurality of horizontally oriented outlet pipes 44 each terminating at a low loss contraction cone 46 and joined together at a fitting 43. Fitting 43 is shown by way of example only as a cross type fitting, but may be any type of fitting or a plurality of fittings depending on the number of outlet pipes 44. The diameter and length of outlet pipes 44 and the cone dimensions of low loss contraction cones 46 are designed using the anticipated volume of water exiting outlet pipe 27 when the reservoir 10 is draining to encourage flow from all areas of the lower portion of the reservoir. A check valve 42 is shown and required in the embodiment of FIGS. 6 and 7 because these figures depict a reservoir with a single inlet/outlet line 18. Check valve 42 in FIGS. 6 and 7 can be any type of check valve located anywhere along outlet pipe 27 and, while shown as a single inline valve in outlet pipe 27, may also be three individual check valves respectively located in outlet pipes 44.

The horizontal outlet pipes 44 are shown as roughly equally spaced radially oriented pipes located in lower portion 12 of reservoir 10 such that water is drawn from all areas of the lower portion of the reservoir as shown by outgoing water flow arrows 36. Outlet manifold 40 is shown by example as being centrally located but can be located anywhere within the bottom of reservoir 10 as long as the configuration of manifold 40 and length of outlet pipes 44 induces flow from all areas of the lower portion of the reservoir.

Figure 8:
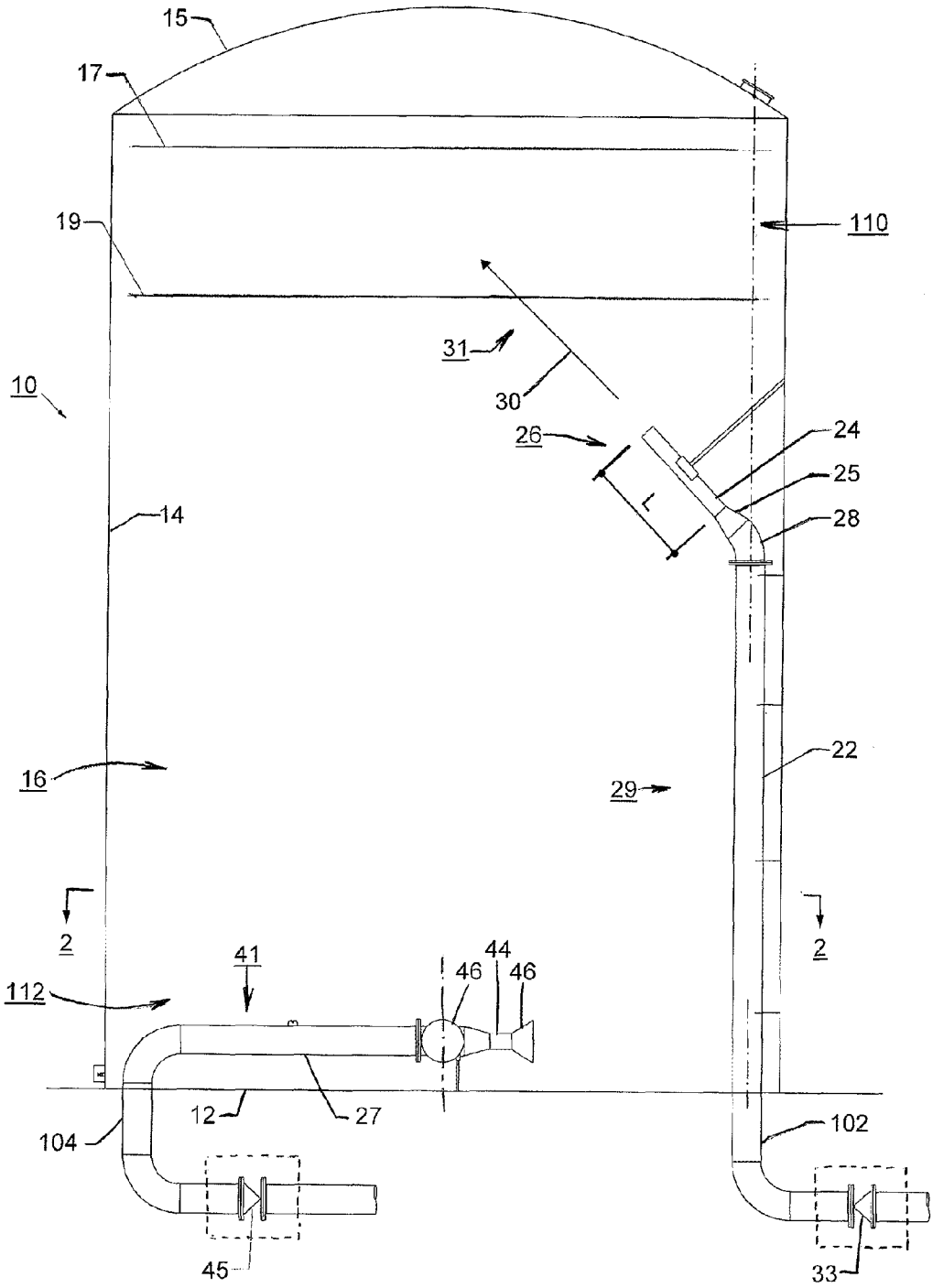
FIG. 8 is an elevation view of a standpipe reservoir or ground storage tank reservoir incorporating a mixing system formed in accordance with the present invention, wherein the mixing system utilizes separate inlet and outlet pipes communicating with the reservoir.
Figure 9:
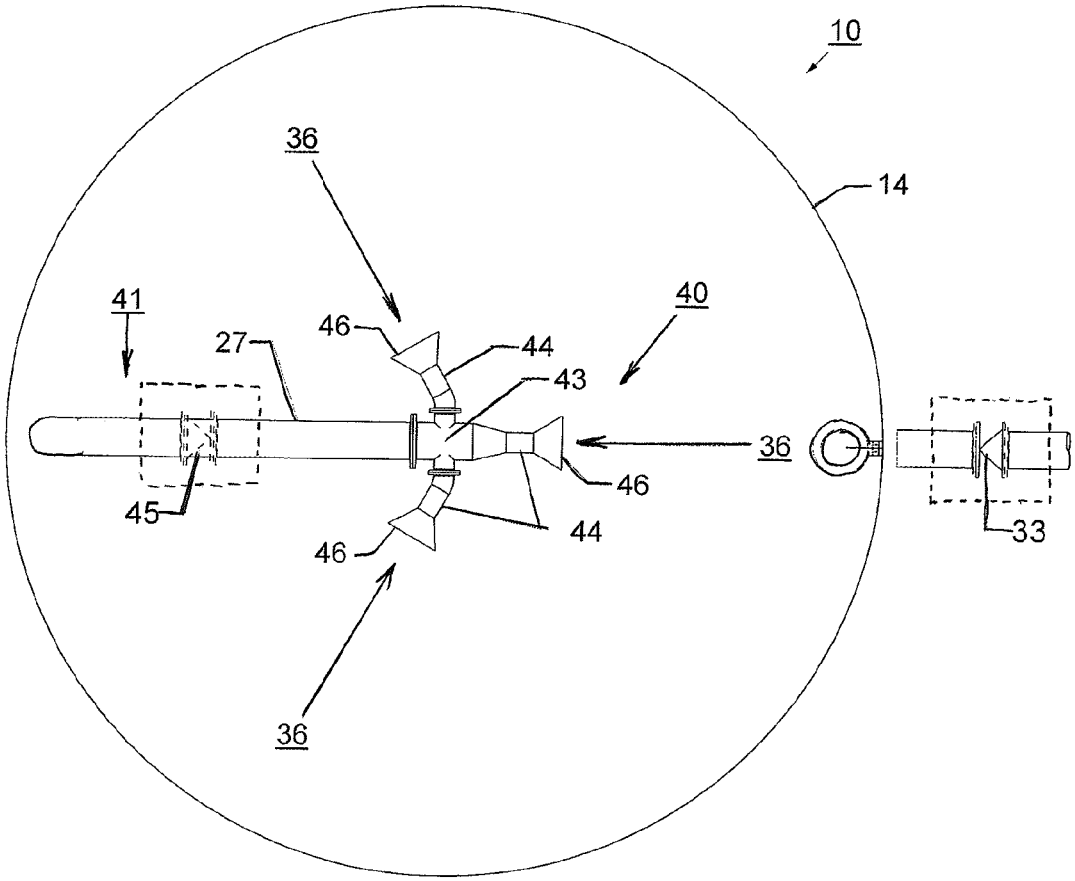
FIG. 9 is a plan view of the lower part of the reservoir shown in FIG. 8, taken along the line 2-2 in FIG. 8.

FIGS. 8 and 9 show another example, generally similar to that shown in FIGS. 6 and 7, of a standpipe reservoir or ground storage tank reservoir 10 storing water contents 16 and incorporating a mixing system in accordance with an embodiment of the present invention. However, in the embodiment shown in FIGS. 8 and 9, the mixing system is connected to separate inlet and outlet pipes 102 and 104 respectively communicating with the reservoir, rather than to a single inlet/outlet pipe as shown in FIGS. 6 and 7. Referring to FIG. 8, and depicted by way of example only, outlet section 41 is connected to outlet pipe 104 and inlet section 29 is connected to inlet pipe 102, wherein pipes 102 and 104 separately exit the reservoir. Inlet pipe 102 and outlet pipe 104 may or may not be joined at a location remote from reservoir 10. By the same token, outlet section 41 and inlet section 29 may or may not be joined at a location remote from the reservoir. Inlet pipe 102 and outlet pipe 104 in FIG. 8 are shown entering reservoir 10 as vertical pipes located adjacent to wall 14 but may enter in a horizontal or inclined position at any location.

All components of the mixing system in FIGS. 8 and 9 are common to the mixing system in FIGS. 6 and 7 with the exception of check valve 32 in inlet section 29 and check valve 42 in outlet section 41, which are normally not required because FIGS. 8 and 9 depict a system with separate inlet 102 and outlet 104 pipes, and the direction of flow may be controlled by remote check valves 33 and 45. An exception to the omission of check valve 32 would be the use of an in-line elastomeric check valve 32 as depicted in FIG. 2B at the entrance to inlet nozzle 26, which check valve may be used when the incoming flow is highly variable to provide some acceleration or momentum to even the very low water flow occasionally entering inlet nozzle 26 by providing variable restriction. Nozzle pipe 24 of length L and the amount of reduction in reducer 25 are designed, using the anticipated flow rate and water pressure entering feed pipe 22 when the reservoir is filling, to provide an inlet nozzle 26 which discharges a developed turbulent jet flow 31 along jet direction 30 as depicted in FIG. 8 which has a velocity sufficient to reach the surface of the liquid.

Outlet section 41 in the embodiment of FIGS. 8 and 9 is similar to outlet section 41 in the embodiment of FIGS. 6 and 7, except that check valve 42 is not required because flow may be controlled by remote valve 45.

It should be apparent to persons skilled in the art that various other modifications and adaptations of the structure described above are possible without departure from the spirit of the invention. Without limiting the generality of the foregoing, some of these modifications and adaptations are illustrated in FIGS. 10 through 20 and described herein as follows.

Figure 10:
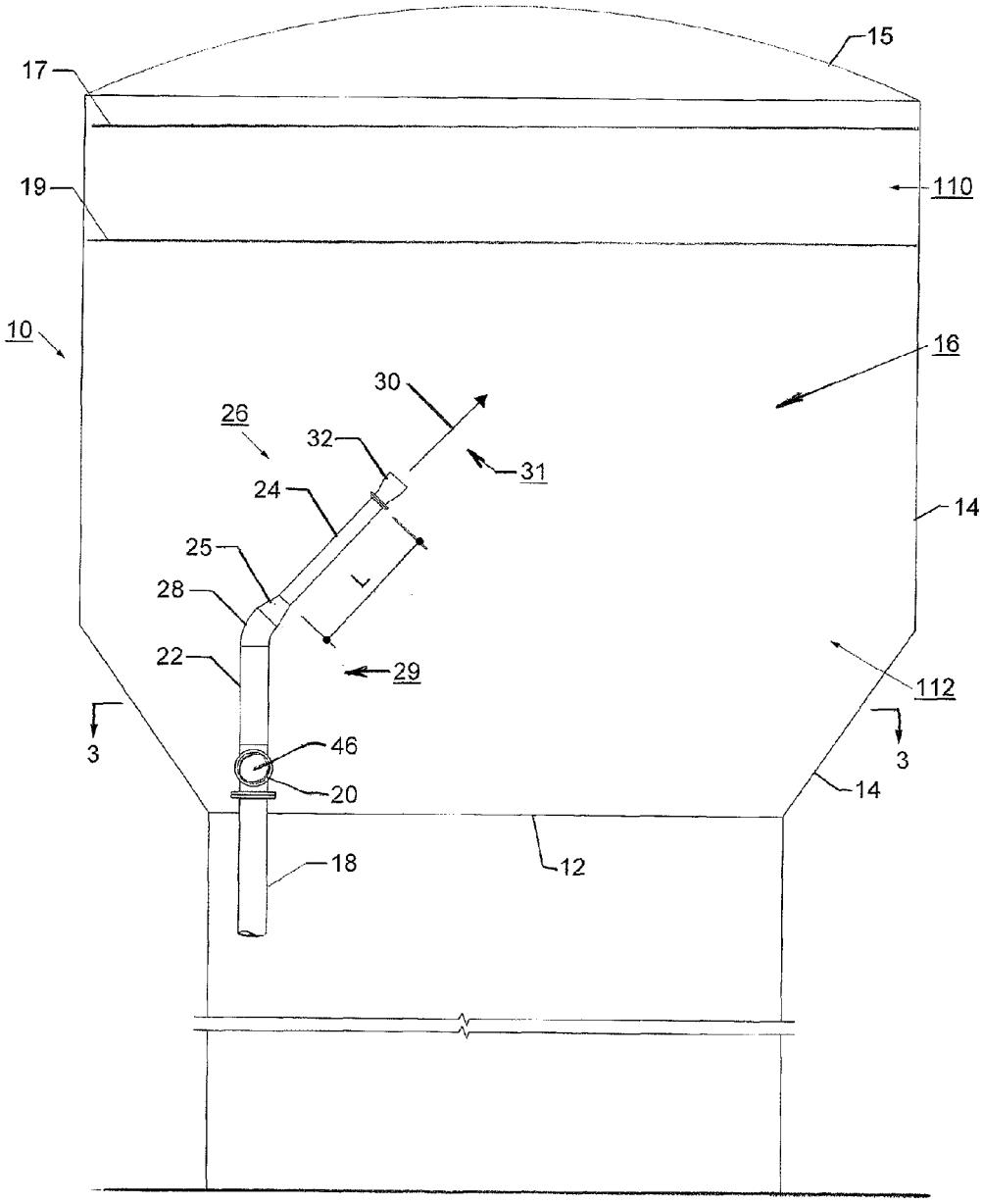
FIG. 10 is an elevation view of an elevated storage tank reservoir incorporating a mixing system in accordance with the present invention, wherein the mixing system utilizes a single inlet/outlet pipe communicating with the reservoir.
Figure 11:
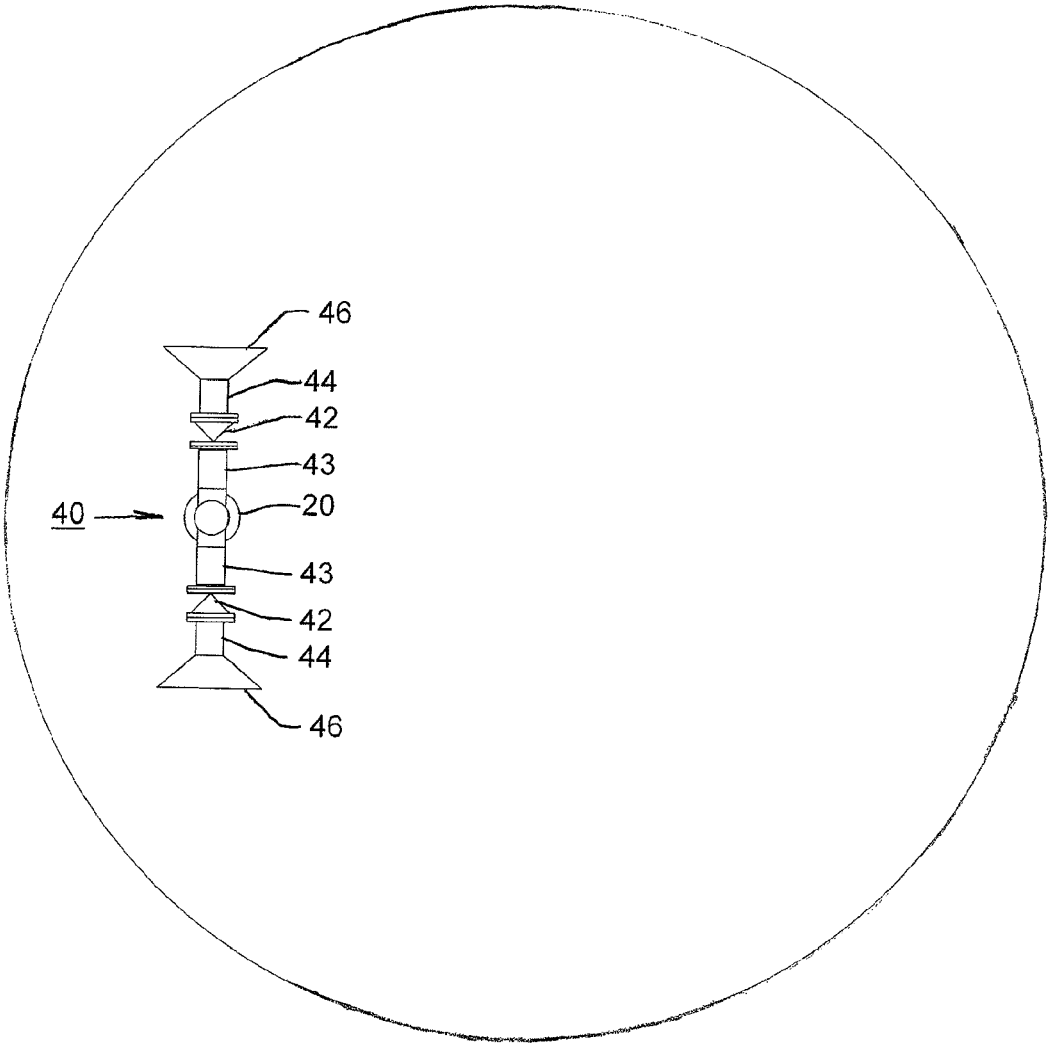
FIG. 11 is a plan view of the lower part of the reservoir shown in FIG. 10, taken along the line 3-3 in FIG. 10.

FIGS. 10 and 11 illustrate an example of the present invention as it would be used in an elevated storage tank or reservoir with a single inlet/outlet pipe.

Figure 12:
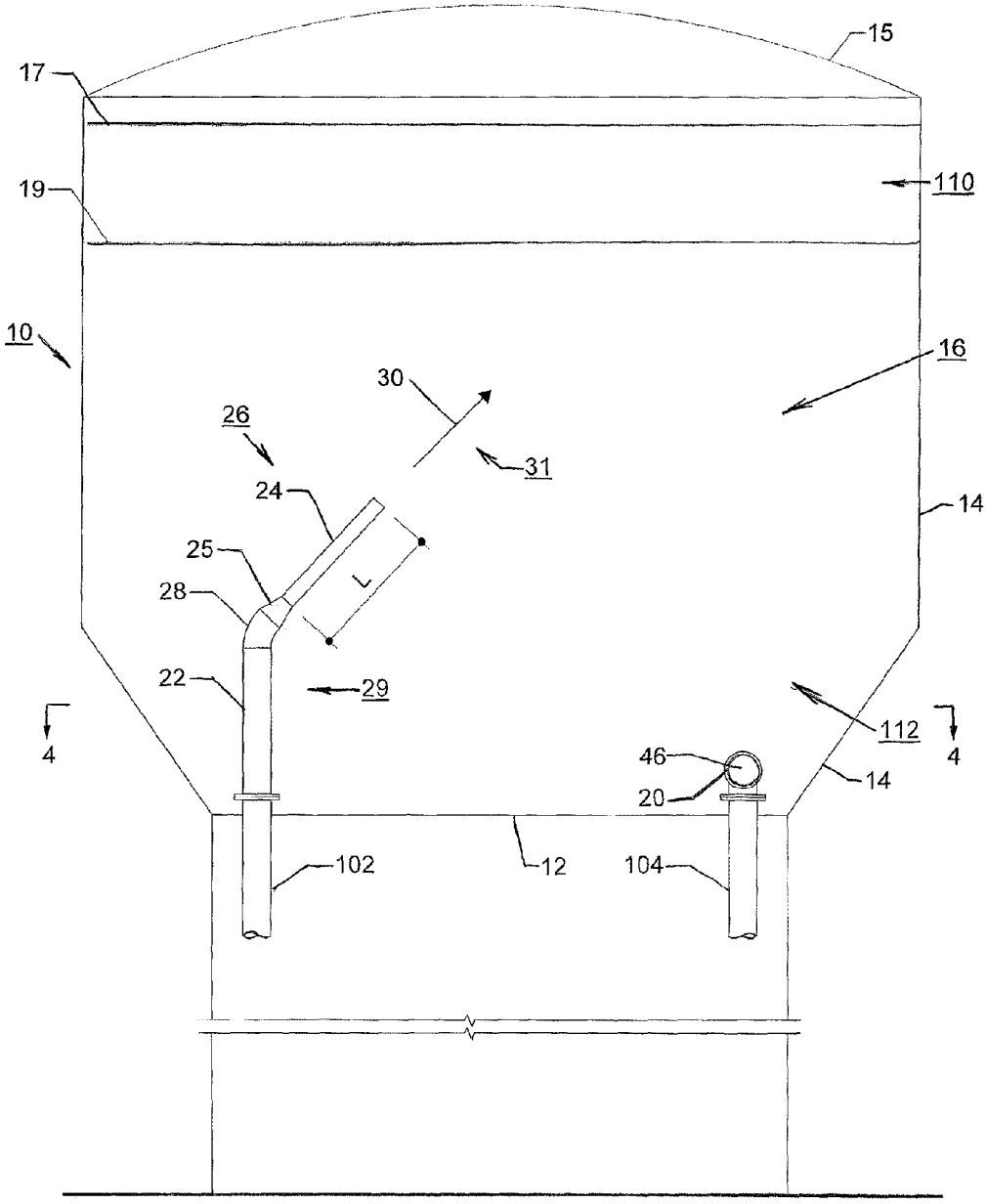
FIG. 12 is an elevation view of an elevated storage tank reservoir incorporating a mixing system formed in accordance with the present invention, wherein the mixing system utilizes separate inlet and outlet pipes communicating with the reservoir.
Figure 13:
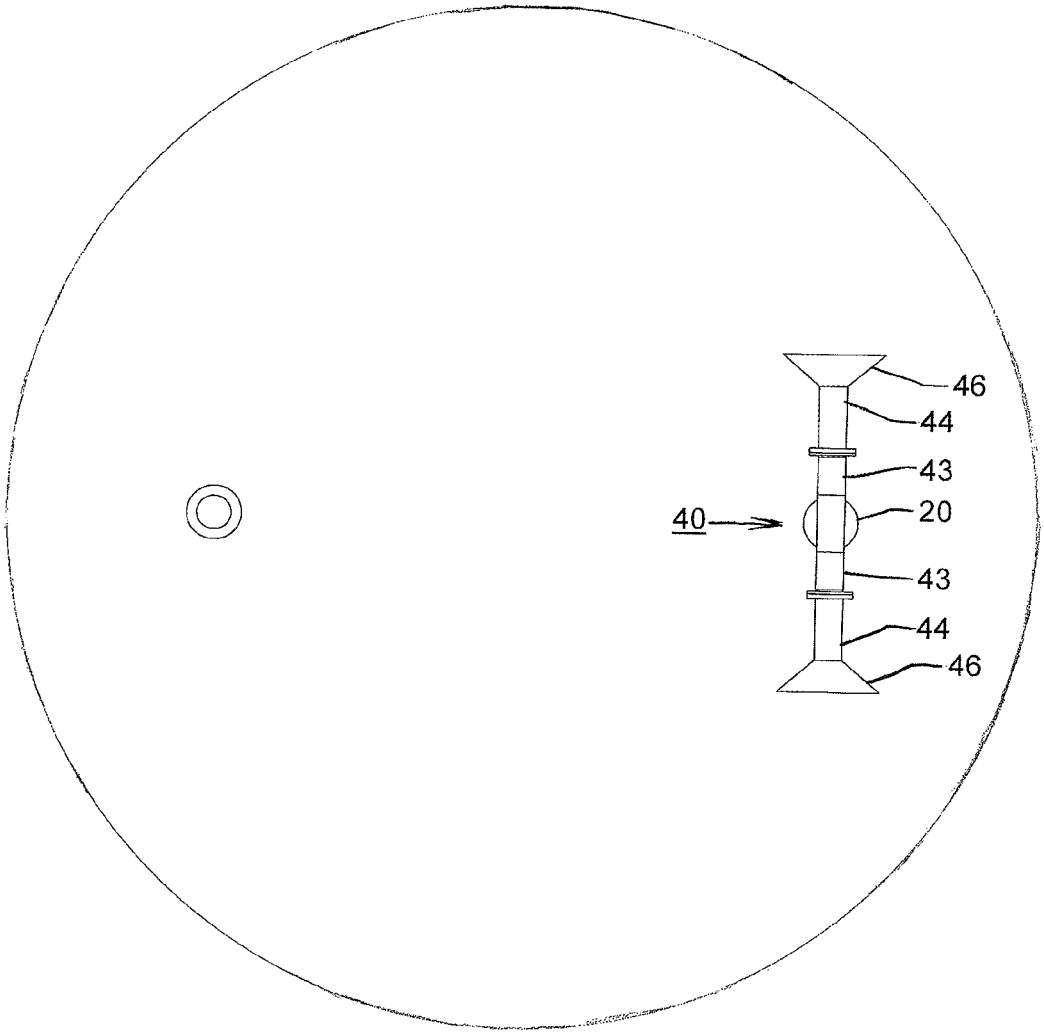
FIG. 13 is a plan view of the lower part of the reservoir shown in FIG. 12, taken along the line 4-4 in FIG. 12.

FIGS. 12 and 13 illustrate an example of the present invention as it would be used in an elevated storage tank or reservoir with separate inlet and outlet pipes.

Figure 14:
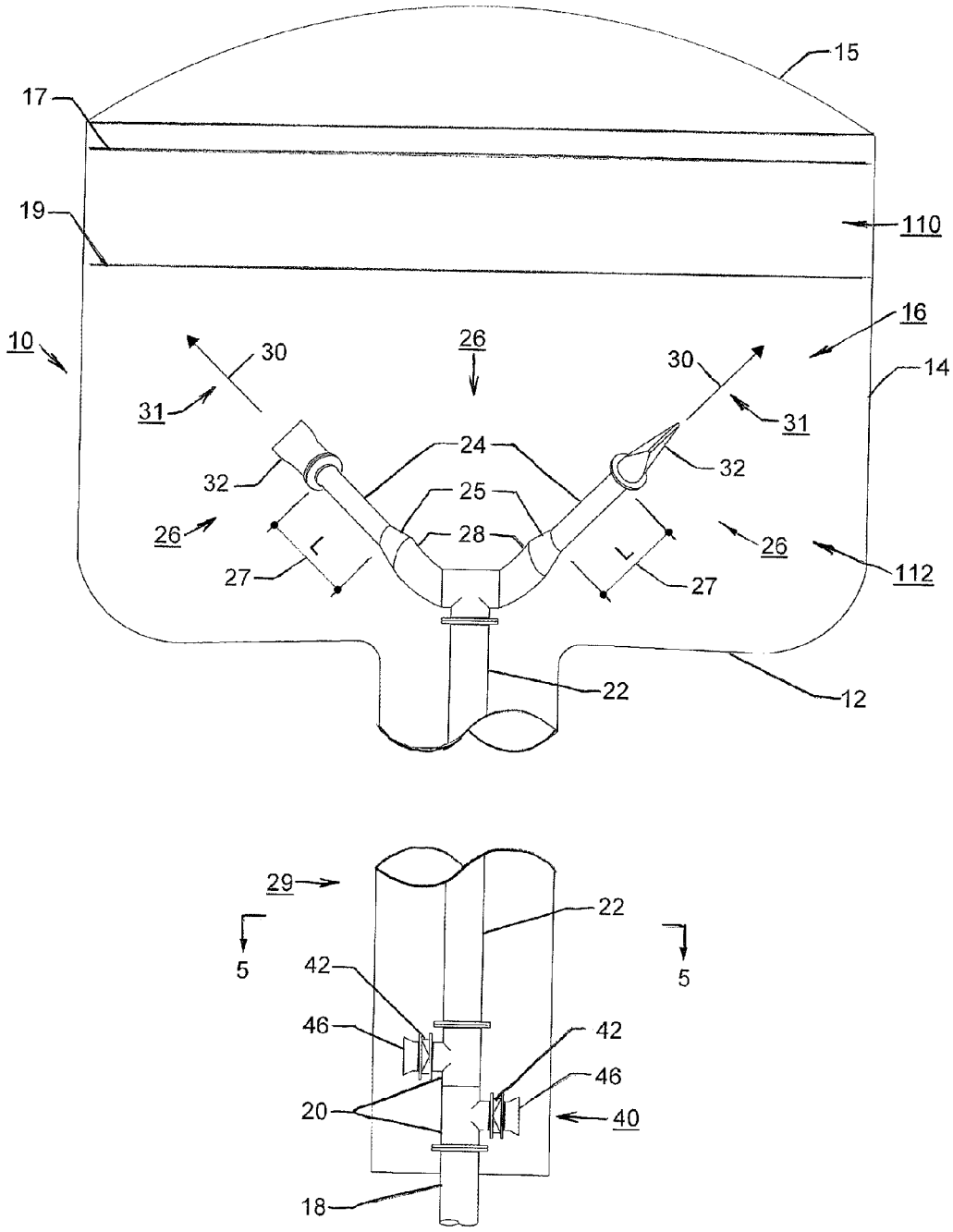
FIG. 14 is an elevation view of an elevated storage tank reservoir incorporating a mixing system formed in accordance with the present invention, wherein the mixing system utilizes a single inlet/outlet pipe communicating with the reservoir, and the reservoir includes an oversized inlet section commonly referred to as a "wet riser"
Figure 15:
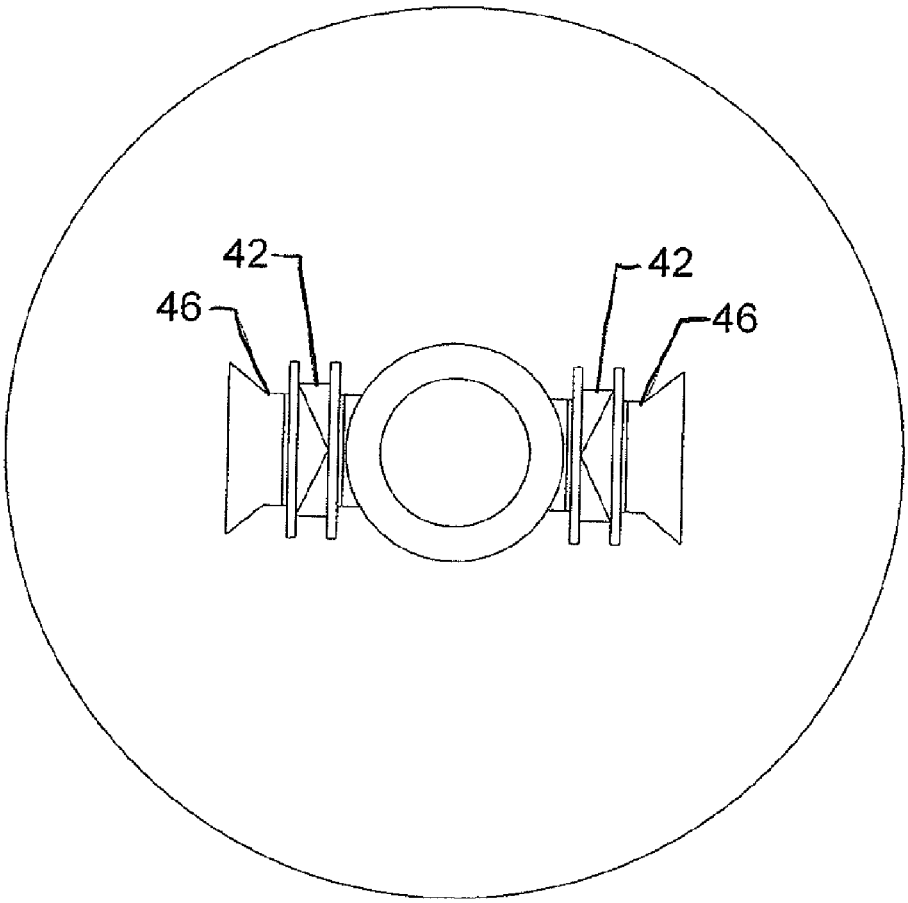
FIG. 15 is a plan view of the lower part of the wet riser shown in FIG. 14, taken along the line 5-5 in FIG. 14.

FIGS. 14 and 15 illustrate an example of the present invention as it would be used in an elevated storage tank or reservoir having a wet riser.

Figure 16:
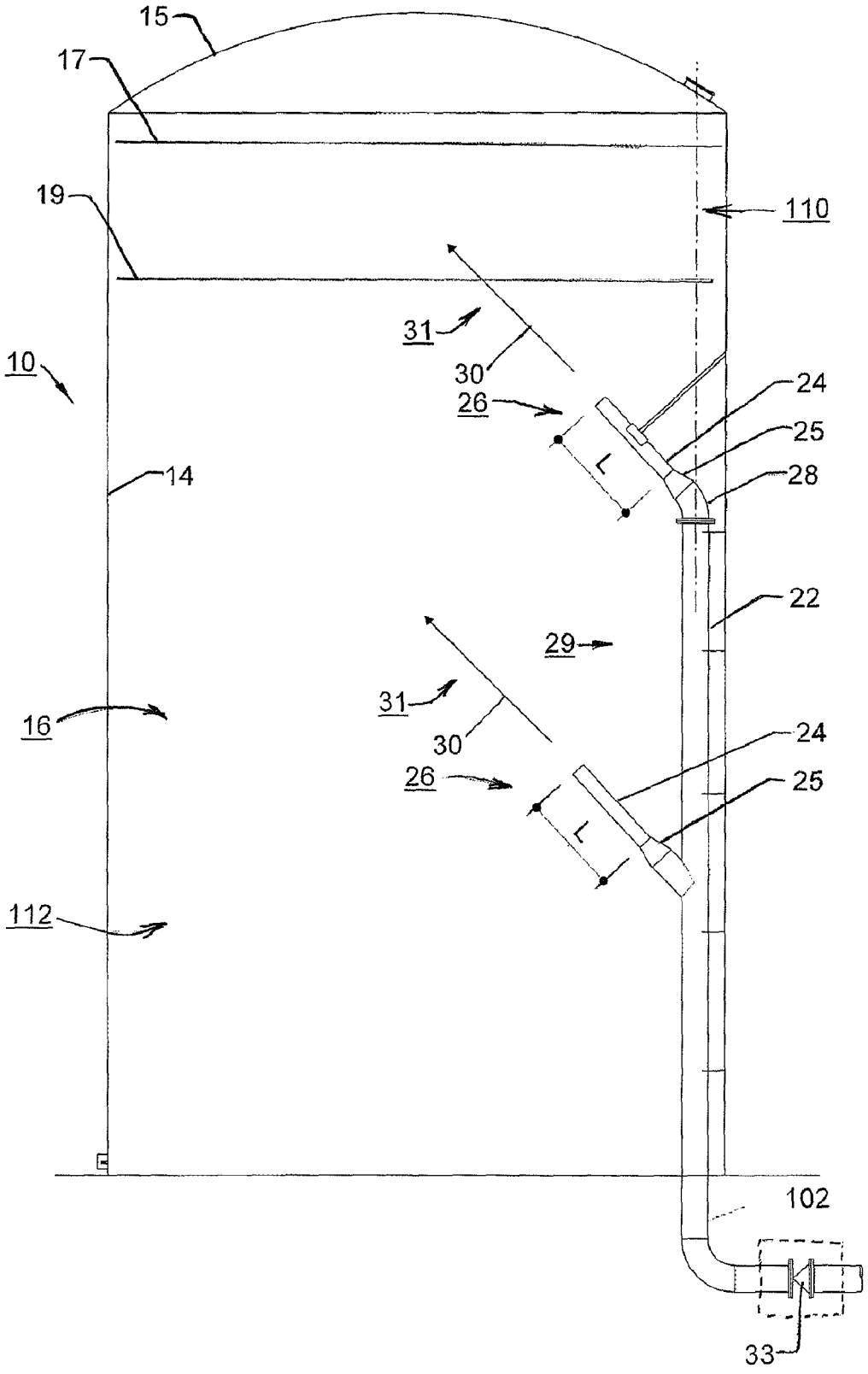
FIG. 16 is an elevation view of a standpipe reservoir or ground storage tank reservoir incorporating a mixing system formed in accordance with the present invention, wherein the mixing system comprises an inlet nozzle system having a plurality of vertically spaced inlet nozzles.

FIG. 16 illustrates an example embodiment of the present invention having a plurality of vertically-spaced inlet nozzles 26, at times required in standpipes having a large height to diameter ratio, which can be utilized without departure from the spirit of the invention.

Figure 17:
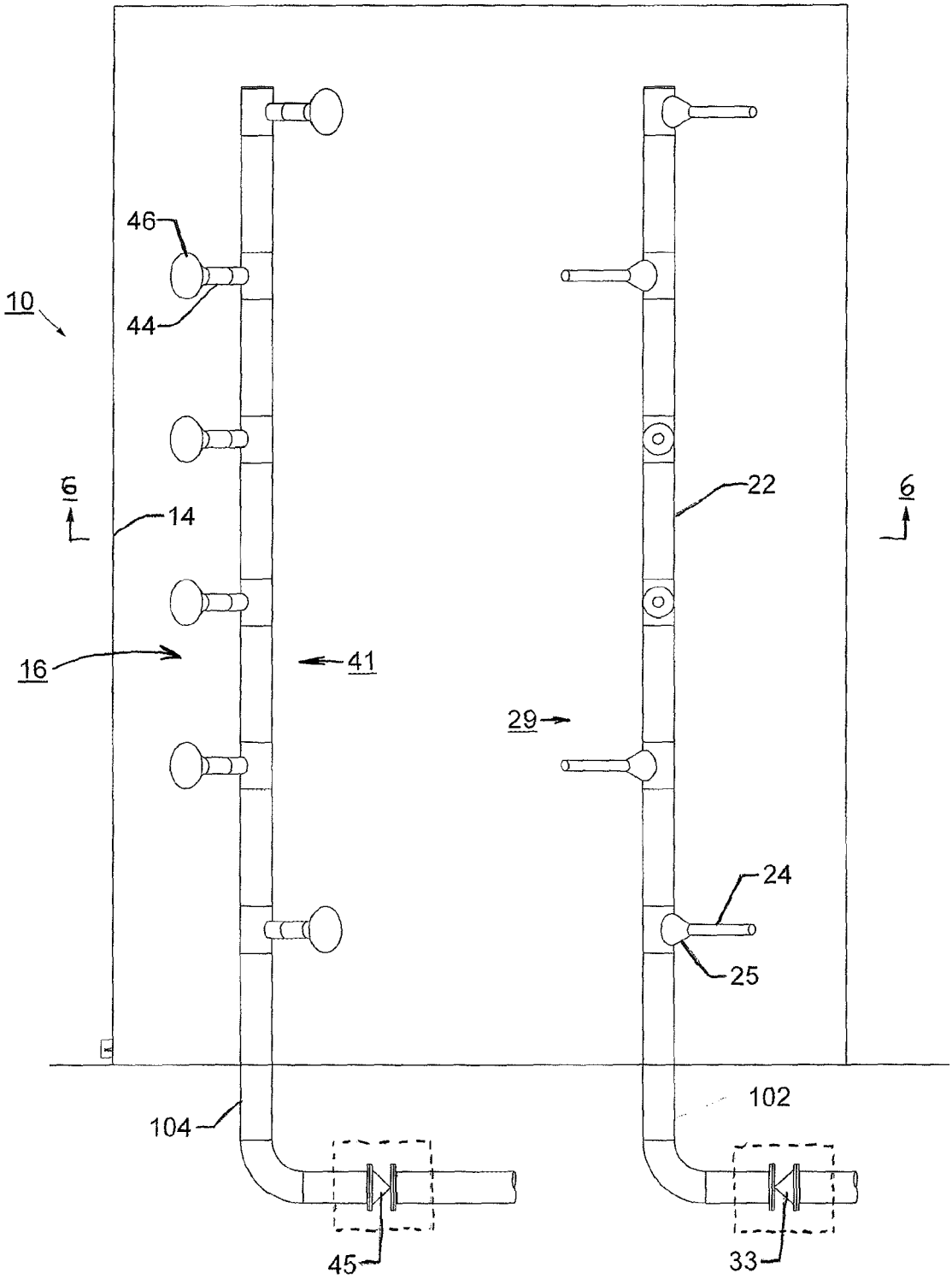
FIG. 17 is a plan view of a rectangular reservoir (normally in-ground) incorporating a mixing system formed in accordance with the present invention, wherein the mixing system includes a plurality of inlet nozzles and outlet cones mounted in series on parallel horizontal headers located remote from each other.
Figure 18A:
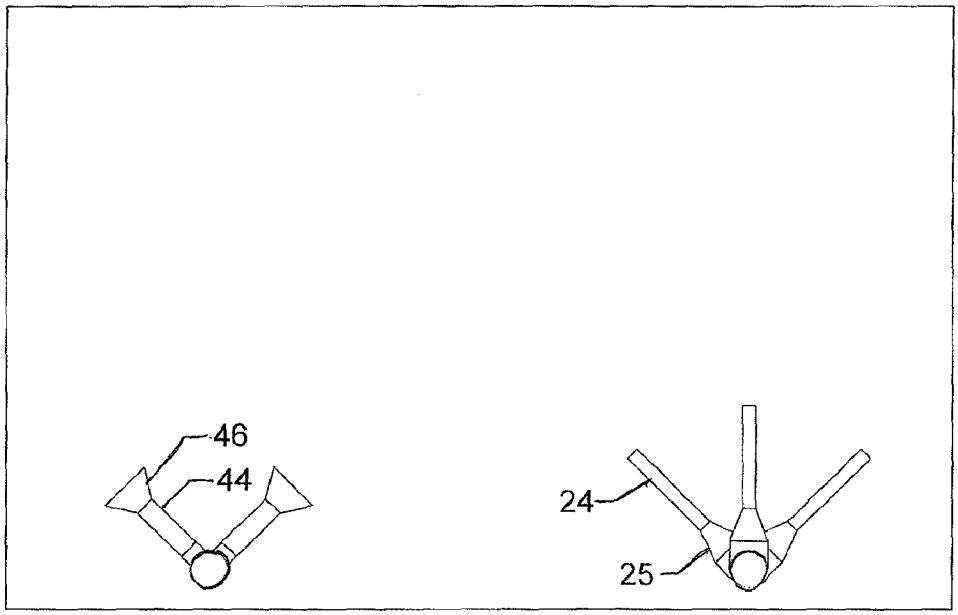
FIG. 18A is a section of the plan depicting a rectangular reservoir taken along the line 6-6 in FIG. 17, for the case where
Figure 18B:
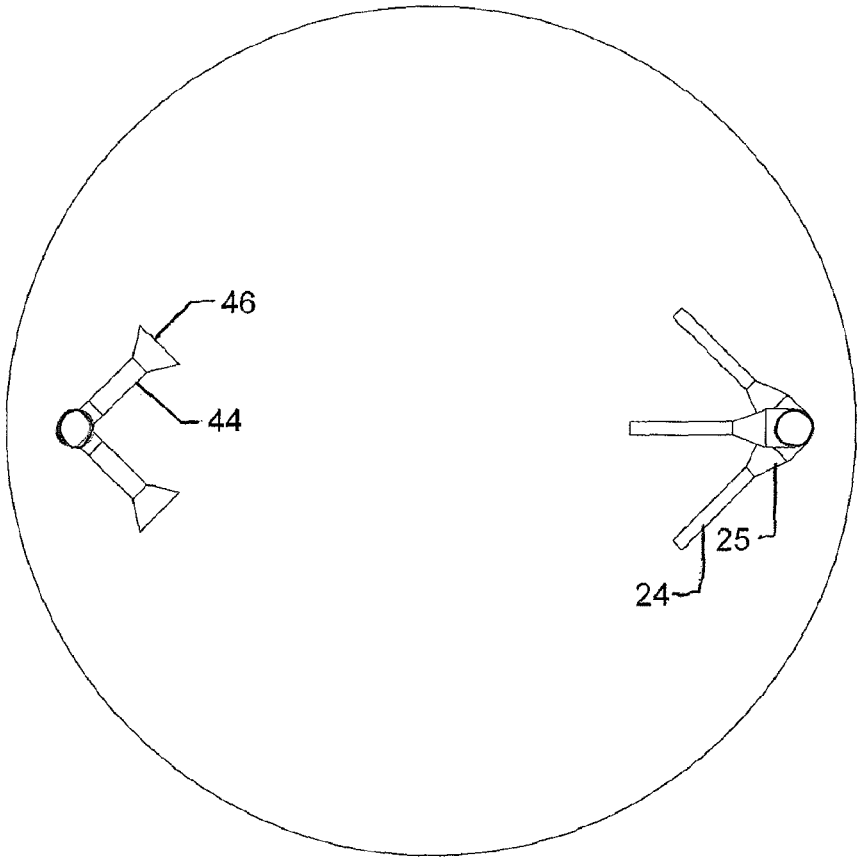
FIG. 18B is a section of the elevation depicting a standpipe or ground storage tank reservoir taken along the line 6-6 in FIG. 17, for the case where

FIGS. 17 and 18A-18B illustrate an example embodiment of the present invention having a plurality inlet nozzles and outlet cone assemblies connected in series along separate inlet and outlet headers in spaced relation to one another. The inlet nozzles may be oriented parallel or otherwise to each other. Likewise, the outlet cone assemblies may be oriented parallel or otherwise to each other. The inlet and outlet headers may extend horizontally or vertically.

Figure 19:
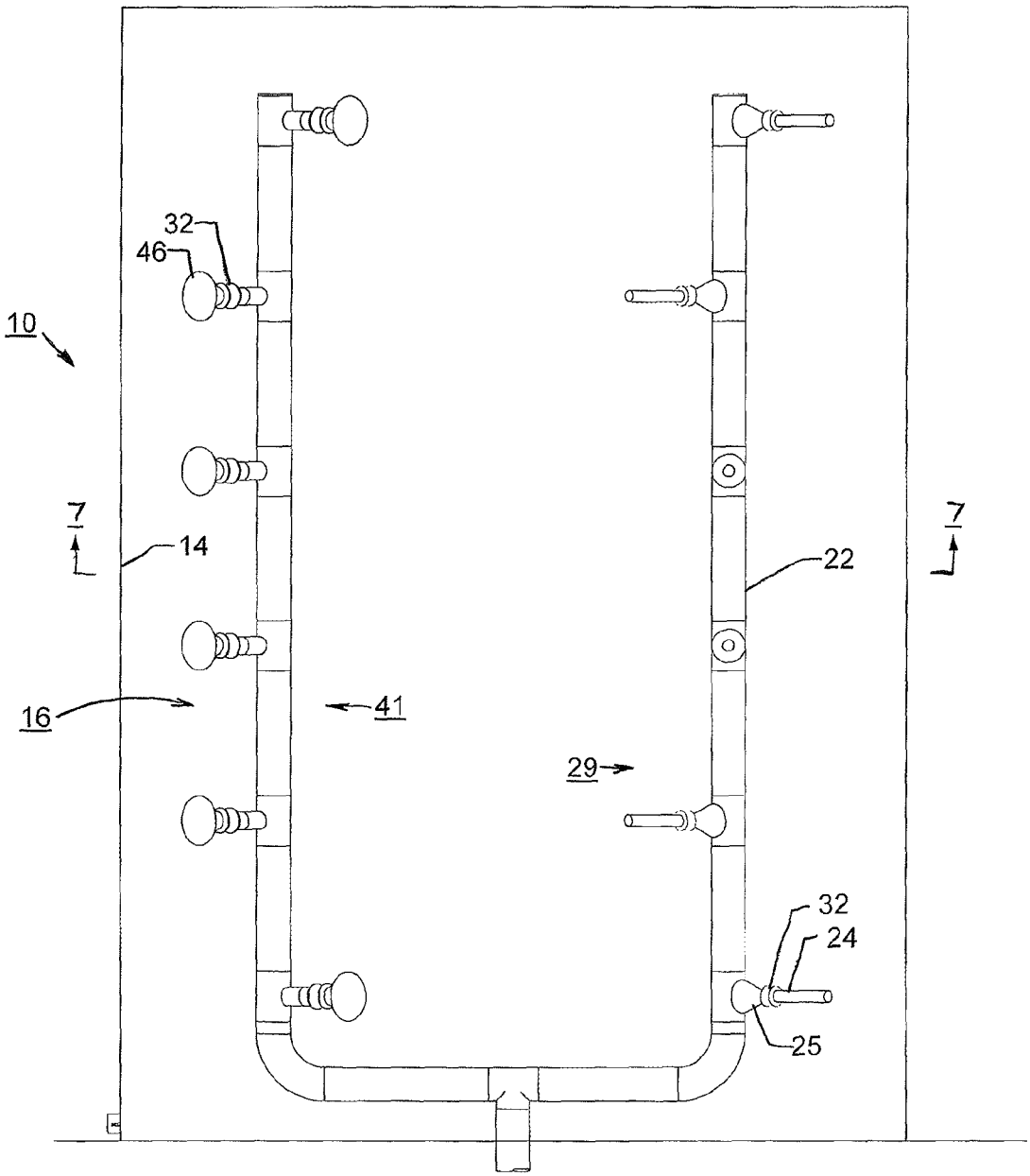
FIG. 19 is a plan view of a rectangular reservoir (normally in-ground) incorporating a mixing system formed in accordance with the present invention, wherein the mixing system includes a plurality of inlet nozzles and outlet cones mounted in series on parallel horizontal headers located remote from each other and having a common inlet/outlet header.
Figure 20A:
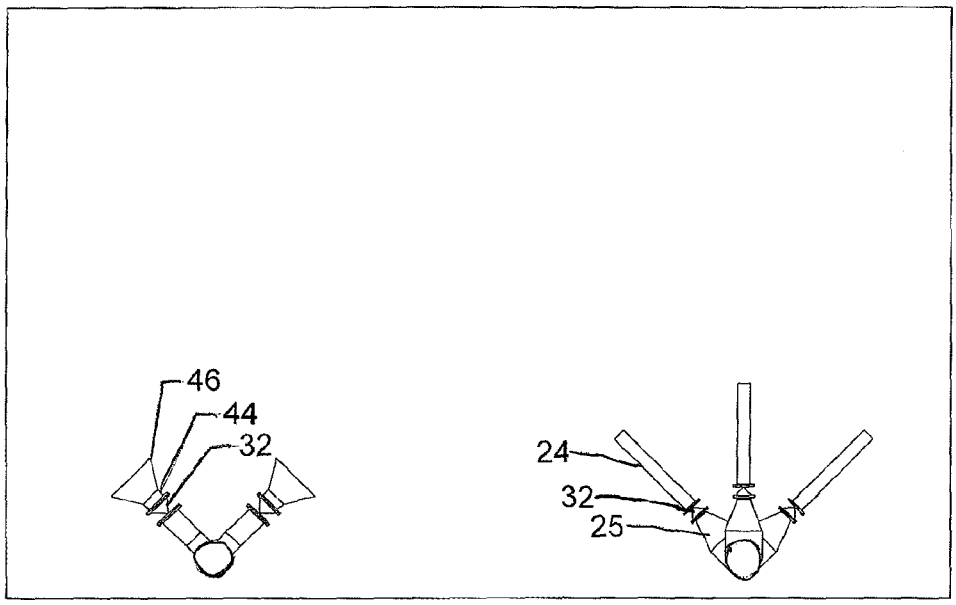
FIG. 20A is a section of the plan depicting a rectangular reservoir taken along the line 7-7 in FIG. 19, for the case where
Figure 20B:
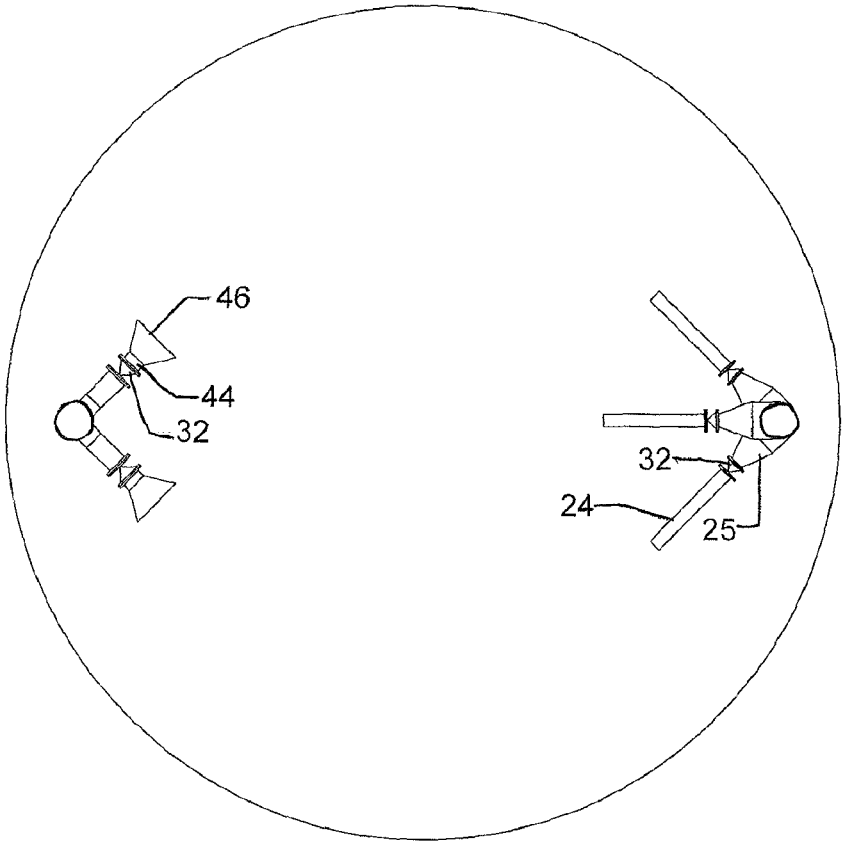
FIG. 20B is a section of the elevation depicting a standpipe or ground storage reservoir taken along the line 7-7 in FIG. 19, for the case where

FIGS. 19 and 20A-20B illustrate an example embodiment of the present invention having a plurality inlet nozzles and outlet cone assemblies connected in series along respective inlet and outlet headers which in turn are connected to a common inlet/outlet header. The inlet nozzles may be oriented parallel or otherwise to each other. Likewise, the outlet cone assemblies may be oriented parallel or otherwise to each other. The inlet and outlet headers may extend horizontally or vertically.

A person, skilled in the art, will note and appreciate various aspects of the present invention, including the following aspects:

Incoming fresh water is directed to upper portion 110 in reservoir 10 via a developed turbulent jet flow along jet direction 30 to encourage mixing first with water in upper portion 110 most remote from the point of withdrawal.

The developed turbulent jet flow along jet direction 30 reaches the surface of the water at approximately the center of the water surface, from which point the turbulent jet flow initiates a flow in contents of upper portion 110 first to an area of wall 14 most remote from inlet 26 and subsequently deflected by wall 14 in a vertical and horizontal rotating direction to further enhance total mixing with reservoir contents 16.

Water is drawn from the entire lower portion 112 of the reservoir contents due to the orientation, sizing and configuration of manifold 40 and the use and design of low loss contraction cones 46. The number and radial length of outlet pipes 44 depends upon the reservoir size and the location of outlet manifold 40.

During times of reservoir filling, water is prevented from initially entering the lower portion 112 of the reservoir contents by check valve 42 or remote check valve 45 and during times of withdrawal, water is prevented from leaving upper portion 110 in the reservoir by check valve(s) 32 or remote check valve 33.

Incoming fresh water 31 which has a negative buoyancy, i.e. is colder than existing reservoir contents (a common hot weather or summer condition) will be directed first to the top surface of upper portion 110 in reservoir 10 by a developed turbulent jet flow along jet direction 30 and will subsequently, due to negative buoyancy, migrate toward lower portion 112 thus accelerating mixing first with the reservoir contents in upper portion 110 most remote from the point of withdrawal and subsequently with the entire reservoir contents 16. Furthermore, it will be recognized that this accelerated mixing is a desirable condition during warm weather when disinfectant concentrations decrease at the fastest rate.

Incoming fresh water 31 which has a positive buoyancy, i.e. is warmer than existing reservoir contents (a common cold weather or winter condition) will be directed first to the top surface of upper portion 110 of the reservoir contents by a developed turbulent jet flow along jet direction 30 and will subsequently, due to positive buoyancy have less tendency to immediately migrate toward the lower portion 112 of the contents of reservoir 10. Furthermore it will be recognized that this is a desirable condition during cold weather because the extended residency of the warmer water in upper portion 110 will ensure that a dangerous ice cap does not form.

The required number and orientation of inlet nozzles 26 will depend on factors which include but are not necessarily limited to the configuration (diameter and height) of the reservoir and the rate of reservoir filling which affects the discharge velocity of the inlet nozzles. Furthermore, it will be realized that one or a plurality of inlet nozzles 26 can be utilized without departure from the spirit of the invention. In addition, it will be realized that a plurality of inlet nozzle locations within the reservoir can be utilized without departure from the spirit of the invention.

There may be reservoir configurations which necessitate a number of vertical or horizontal locations of inlet nozzles. Furthermore, it will be realized that one or a plurality of vertical or horizontal locations of inlet nozzles can be utilized without departure from the spirit of the invention.

The required number and orientation of outlet pipes will depend on factors which include but are not necessarily limited to the size or diameter of the reservoir. Furthermore, it will be realized that one or a plurality of outlet pipes can be utilized without departure from the spirit of the invention.

Use of low loss contraction cones will depend on factors which include but are not necessarily limited to the size or diameter of the reservoir. Furthermore, it will be realized that low loss contraction cones can be deleted where space dictates or where appropriate without departure from the spirit of the invention.

The design diameter and length of inlet nozzle pipe 24 is critical to the proper functioning of inlet nozzle 26 so that the optimum developed turbulent jet flow is created. Further, it will be realized that an inlet nozzle which is too small, while providing greater velocity to the discharge, will back pressure the system and create head loss problems with the control mechanism and; yet further, it will be realized that an inlet nozzle pipe which is too long will hinder the initiation of mixing with the tank contents and; yet finally, an inlet nozzle pipe which is too short will introduce the water in a hydraulically chaotic manner, not the required developed turbulent jet flow. An ideal length of a nozzle pipe is the length just adequate to develop a turbulent jet flow and direct the jet flow to a desired portion of the tank.

A mixing system which attempts to maximize total mixing of reservoir contents must take into account specific parameters which include the reservoir size and shape, size of inlet and outlet pipes, flow rates during filling and draining at various times of the day and days of the week and water temperatures during various seasons of the year. Further, it will be realized that this data, modeled in a CFD (computational fluid dynamics) system, or similar equivalent, will facilitate the most efficient inlet nozzle(s) and outlet manifold design. Further, it will be realized that head loss calculations must be performed to ensure that the mixing system as designed can be adapted to present control systems.

A system has been created which consistently places the incoming, fresh, treated and (in winter) warmer water first at the top of reservoir 10 while forcing the withdrawal from the bottom.

A system has been created which provides maximum acceleration to the mixing of the incoming, fresh, treated water with existing tank contents during periods of negative buoyancy (summer) when this is most desirable.

A system has been created which reduces the potential for dangerous ice cap formation during periods of positive buoyancy (winter) when this is most desirable.

A system has been created which combines mixing and the removal of potentially dangerous ice caps in a manner superior to any previously proposed systems.

What is claimed is:

1. An inlet nozzle for injecting water into a reservoir, the inlet nozzle comprising:

a first directional fitting;

a first reducing fitting connected to the first directional fitting, the first reducing fitting increasing the velocity of incoming water;

a first nozzle pipe connected to the first reducing fitting, the first nozzle pipe converting increased velocity water into a developed turbulent jet flow; and a check value preventing backflow of water from reservoir through the inlet nozzle.

2. The inlet nozzle according to claim 1, wherein the check valve is located at a discharge end of the first nozzle pipe.

3. The inlet nozzle according to claim 1, wherein the check valve is located between the first reducing fitting and the first nozzle pipe.

4. The inlet nozzle according to claim 1, wherein the check valve is located between the first directional fitting and the first reducing fitting.

5. The inlet nozzle according to claim 1, wherein the check valve is located before the first directional fitting.

6. The inlet nozzle according to claim 1, wherein the inlet nozzle further comprises a second reducing fitting and a second nozzle pipe connected to the second reducing fitting, and the first and second reducing fittings are connected to the first directional fitting by a first Y-fitting, whereby a developed turbulent jet flow is discharged from each of the first and second nozzle pipes.

7. The inlet nozzle according to claim 1, wherein the inlet nozzle further comprises a second directional fitting, a second reducing fitting connected to the second directional fitting, and a second nozzle pipe connected to the second reducing fitting, and the first and second directional fittings are connected by a T-fitting, whereby a developed turbulent jet flow is discharged from each of the first and second nozzle pipes.

8. The inlet nozzle according to claim 6, wherein the inlet nozzle further comprises a third reducing fitting and a third nozzle pipe connected to the third reducing fitting, and the second and third reducing fittings are connected to the first Y-fitting by a second Y-fitting, whereby a developed turbulent jet flow is discharged from each of the first, second, and third nozzle pipes.

9. An inlet nozzle system for injecting water into a reservoir, the inlet nozzle system comprising:

an inlet header;

a plurality of inlet nozzles mounted in series along the inlet header, each of the plurality of inlet nozzles including a directional fitting, a reducing fitting connected to the directional fitting, the first reducing fitting increasing the velocity of incoming water, and a first nozzle pipe connected to the first reducing fitting, the first nozzle pipe converting increased velocity water into a developed turbulent jet flow; and a check value parenting backflow of water from reservoir through the inlet nozzle.

10. The inlet nozzle system according to claim 9, wherein the inlet header is a horizontal inlet header and the plurality of inlet nozzles are spaced from one another in a horizontal direction.

11. The inlet nozzle system according to claim 9, wherein the inlet header is a vertical inlet header and the plurality of inlet nozzles are spaced from one another in a vertical direction.

* * * * *